US006685386B1

(12) United States Patent
Lee

(10) Patent No.: US 6,685,386 B1
(45) Date of Patent: Feb. 3, 2004

(54) INTERSECTION SYSTEM

(76) Inventor: Jang Hee Lee, 224-1306, Family Apt., Munjung-Dong, Songpa-Gu, Seoul 138-200 (KR)

( * ) Notice: Subject to any disclaimer, the term of this patent is extended or adjusted under 35 U.S.C. 154(b) by 0 days.

(21) Appl. No.: 09/573,278

(22) Filed: May 18, 2000

Related U.S. Application Data

(63) Continuation-in-part of application No. PCT/KR98/00366, filed on Nov. 17, 1998.

(30) Foreign Application Priority Data

Nov. 19, 1997 (KR) ..... 1997-61140

(51) Int. Cl.[7] ..... E01C 1/02; E01C 1/04
(52) U.S. Cl. ..... 404/1
(58) Field of Search ..... 404/1

(56) References Cited

U.S. PATENT DOCUMENTS

| | | | | | |
|---|---|---|---|---|---|
| 1,173,505 | A | * | 2/1916 | Hale | 404/1 |
| 1,515,251 | A | * | 11/1924 | Graves | 404/1 |
| 1,543,080 | A | * | 6/1925 | Graves | 404/1 |
| 1,689,161 | A | * | 10/1928 | Skultin | 404/1 |
| 1,784,728 | A | * | 12/1930 | Harriss | 404/1 |
| 1,981,361 | A | * | 11/1934 | Jones | 404/1 |
| 2,941,454 | A | * | 6/1960 | Cedeno | 404/1 |
| 2,946,267 | A | * | 7/1960 | Cedeno | 404/1 |
| 2,949,067 | A | * | 8/1960 | Cedeno | 404/1 |
| 3,107,590 | A | * | 10/1963 | Cedeno | 404/1 |
| 3,238,854 | A | * | 3/1966 | Okubo | 404/1 |
| 3,394,638 | A | * | 7/1968 | Burrell | 404/1 |
| 4,272,210 | A | * | 6/1981 | Shoji et al. | 404/1 |
| 4,592,673 | A | * | 6/1986 | Lee | 404/1 |
| 4,955,751 | A | * | 9/1990 | Tsai | 404/1 |
| 5,049,000 | A | * | 9/1991 | Mier et al. | 404/1 |
| 5,795,095 | A | * | 8/1998 | Heller | 404/1 |
| 5,921,701 | A | * | 7/1999 | Clayton | 404/1 |

FOREIGN PATENT DOCUMENTS

| | | | | | |
|---|---|---|---|---|---|
| AU | 233857 | | * | 5/1961 | 404/1 |
| DE | 3938945 | A1 | * | 8/1990 | E01C/1/04 |
| DE | 4135693 | A1 | * | 4/1993 | 404/1 |
| FR | 2681620 | | * | 3/1993 | E01C/1/02 |
| JP | 405025802 | A | * | 2/1993 | E01C/1/04 |
| JP | 40532904 | A | * | 5/1993 | E01C/1/04 |
| SU | 0804748 | | * | 2/1981 | 404/1 |
| SU | 1335608 | A1 | * | 9/1987 | 404/1 |

* cited by examiner

*Primary Examiner*—Robert E. Pezzuto
*Assistant Examiner*—Alexandra K. Pechhold
(74) *Attorney, Agent, or Firm*—Hamilton, Brook, Smith & Reynolds, P.C.

(57) ABSTRACT

An intersection system which can do without, or drastically minimize, the frequency of having to wait for traffic signals in order to relieve traffic of congestion and minimize the land occupied by an intersection system. System 1 consists of two mutually intersecting roads, main road 1 and main road 2, each including a diverging section for cars making a left or right turn and a converging section for convergence of cars heading in the same direction after having taken their respective left or right turns; System 2, which has a ring-shaped road on the upper and the lower level each at the central section of an intersection, and half-main-roads and entries being connected on the outer circumferences of these ring-shaped roads; and System 3, which has a plate-shaped road for right and left turns on an upper and lower level at the central section of an intersection, the plate-shaped roads having half-main-roads and entrance roads built on the edges, and a minimum number of traffic lights, unavoidably, set up on said plate-shaped roads or each entrance road for the benefit of cars advancing from all directions.

5 Claims, 37 Drawing Sheets

INTERSECTION SYSTEM

RELATED APPLICATION(S)

This application is a continuation-in-part of International Application number PCT/KR98/00366 filed Nov. 17, 1998 which claims priority to Korean Patent Application number 97-61140 filed Nov. 19, 1997, the entire teachings of which are incorporated herein by reference.

BACKGROUND

Ways of controlling traffic at an intersection are, in general, of two kinds, one which by means of erected traffic lights controls cars coming from all directions, helping them take turns passing in a direction at a time, and the other one which, like an expressway, by means of elevated road structures and with no traffic lights, simply leaves cars to pass nonstop through by either the upper or the lower level of roads.

Traffic lights usually delay traffic, often causing grievous congestion. It is desirable, therefore, to have the fewest possible traffic lights or, if ever possible, none at all.

Multilevel intersection systems are better than others, for cars can pass nonstop through without having to wait for the green, but construction of a clover leaf or another similar system demands quite a sizable lot of land and is often found all but impracticable in areas where, as in urban centers, land prices are forbidding. In addition, problems arise at times for drivers when accesses for left and right turns vary from place to place.

SUMMARY

The present invention is intended to provide a new intersection system, which uses less land usually required for one and yet is convenient for automobiles to go straight on or turn right or left, either entirely free of interruption by signal lights, or if not entirely free, subject to the least possible interruption.

Another objective of the present invention is to provide an intersection system, which can curtail the time spent by cars awaiting the change of lights.

With a view of attaining these objectives, the present invention provides the three following systems:

(1) System 1 of the present invention comprises two mutually intersecting roads, "main roads" 1 and 2. At the entrance portion of the intersection, a "diverging section" is provided, where the main road diverges in three ways, one for the straight way onward, a second for the right turn, and a third for the left turn; while at the exit portion of the intersection a "converging section" is provided for the three ways reaching there to converge into one. In other words, at each diverging section the road branches off in three ways and at the converging section three ways join to become one road.

The main roads are built on two levels at both the diverging and converging sections of an intersection, and when a main road in one direction takes the lower level at the diverging section, it must take the upper level at the converging section, and vice versa. The main roads ascend, or slopes downward at the central section of an intersection, between the diverging and converging sections. If main road 1 is on the upper level at the central section of an intersection, main road 2 takes the lower level there, and vice versa.

Accordingly either one of the two main roads takes the upper and the other the lower at the central section of an intersection, the two crossing each other with a space more than the height of a car in between.

An entrance road, that is, the advancing section, of a main road, is connected, at its converging section at the other end, with the other main road, which intersects the first main road, overhead or beneath it, running in the same direction as that of it.

(2) System 2 of the present invention comprises of two ring-shaped roads, one on the upper and the other on the lower level.

On the outer side of a ring one half-main-road joins each in two given directions, and so does an entrance road each in the other two directions.

On a plan view, the half-main-roads on the upper ring and those on the lower ring, and the entrance roads on the upper and those on the lower respectively run in directions different from each other.

Meanwhile, either more than one of the two one-way roads that constitute a half-main-road or an entrance road, each embody a sloping section, while an entrance road joins with either one of the one-way roads on the lower or upper half-main-road, which runs in the same direction as that of it.

(3) System 3 of the present invention has a plate-shaped road for right turns and another for left turns, added on both the upper and lower levels in the center of the system.

On an edge of each such plate-shaped road, on both the upper and lower levels, a half-main-road joins in each two directions, and an entrance road each in the other two directions.

The half-main-roads on both the upper and lower levels, and the entrance roads of the plate-shaped road on the upper and lower levels, run in directions different from each other, from a plan view, while more than one of the two one-way roads constituting a half-main-road or an entrance road each embody a sloping section. Said entrance roads join with the one-way road of the half-main-road, either on the upper or the lower level, which runs in the same direction.

On each plate-shaped road on the upper or lower level, and on each entering one-way road, a traffic light has to be set up, indeed unavoidably, for the cars coming on from all directions.

Now, in this Specification, a "main road" means a road consisting of a pair of two straight one-way roads, or one-way road passages which traverse the center of an intersection parallel to each other, in opposite directions. The two one-way roads constituting one main road can be separated from each other, of course, on two levels, one over and the other beneath the other.

An "one-way road," here, means one of the pair of passages that constitute a main road, or a half-main-road, which is shown in the examples of embodiment of the present invention as a single lane, but it can very well be made of two or more lanes.

An "upper road" means a road on a level higher than a lower road on a lower level, and is parallel to the surface of the ground, the height not particularly confined to a certain level; a "lower road" means a road which is lower than an upper road and parallel with the surface of the ground, but not necessarily is one that runs on the very ground level.

For instance, to make the length of a sloping section of a road shorter than otherwise, it is possible to build the upper road on an elevated level and the lower road on an underground level.

A "sloping section" means the section of a road that forms a slope to connect an upper and a lower road.

A "central section" means the section of the road that occupies the central part of the intersection system, between its diverging and converging sections.

A "half-main-road" means, of the main road defined in System 1 of the present invention, either one of the two parts of a main road cut in two by the ring-shaped roads of system 2 or plate-shaped roads of system 3.

An intersection, that is, the part connecting the outer area of an intersection with the ring-shaped road or road plate at one end and the part connecting the ring-shaped road or road plate with the outer area of the intersection at the other end.

As regards the directions, it will be seen that the direction approaching the central section of an intersection system is called the entering direction and that leaving the central section is called the departing direction.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
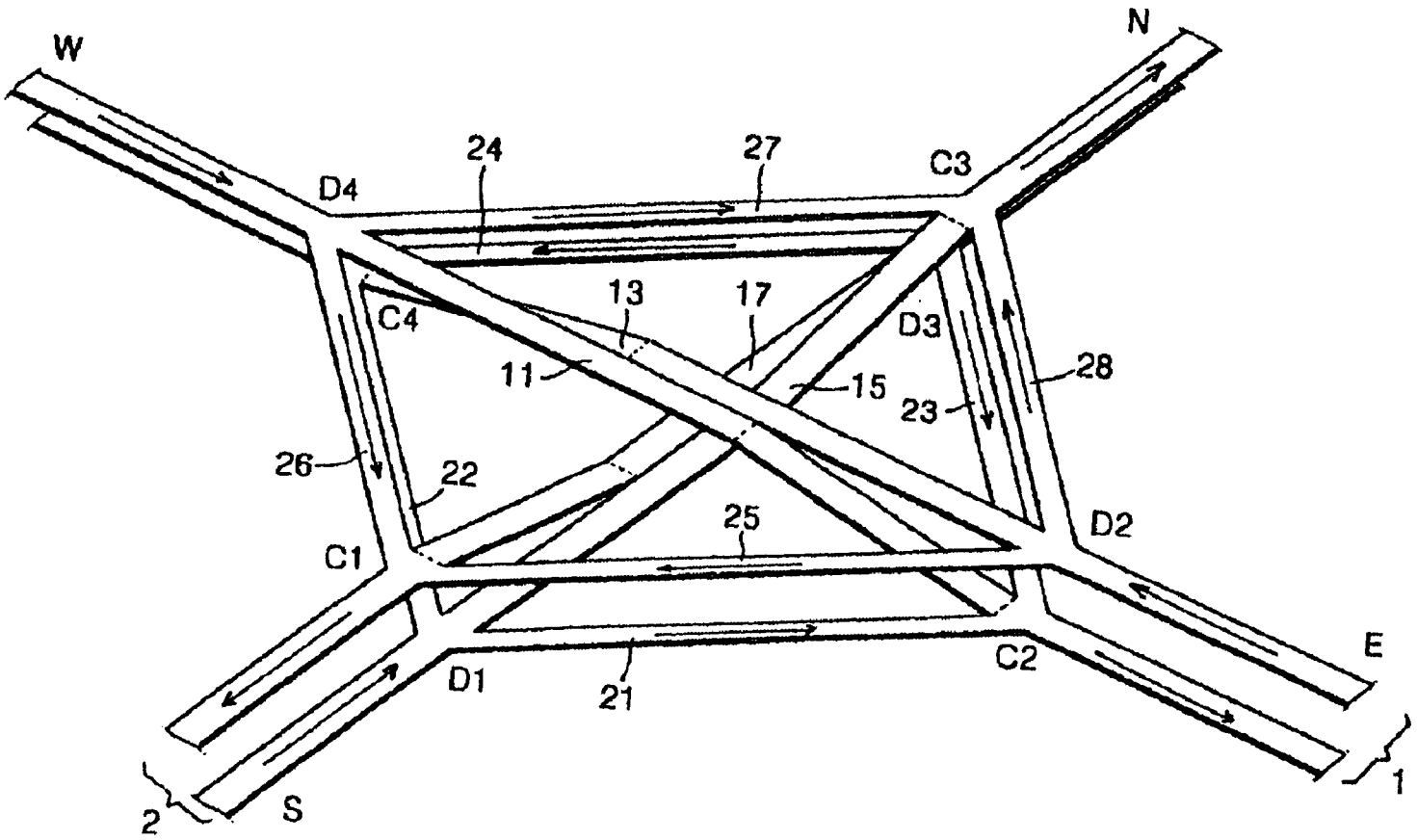
FIG. 1 is a schematic perspective view of an embodiment of System 1 of the present invention.

Below, explanation of various systems of the present invention, making references to the drawings, follows:

The arrow marks in the drawings indicate the directions in which the traffic moves and the dotted lines, where sloping sections begin and end.

The E, W, N, and S on the drawings respectively represent the east, west, north, and south; the movement of traffic from north to south is indicated by NS, and that form south to north by SN. NW, WN, NE, EN, WS, SW, SE, and ES are also used in the same manner. These simultaneously indicate the directions in which traffic moves and the one-way roads head.

Systems of building a road on the surface or underground are out of the range of the present invention. The "upper level road" in the present invention comprises a provisional means to maintain a road at a certain height, which comprises, for example, bridge piers or support walls of prior arts. Locations of such piers or their number are also beyond the range of the present invention.

The drawings show only one lane per one-way road in a direction, but this is only to help easy comprehension of the idea. The present invention is of course applicable to any multilane roads all the same.

Though not illustrated in the drawings, it goes without saying that each road becomes an ordinary road, the upper level road and lower level road merging into one at a certain position after departure from the intersection.

1. System 1

Figure 2:
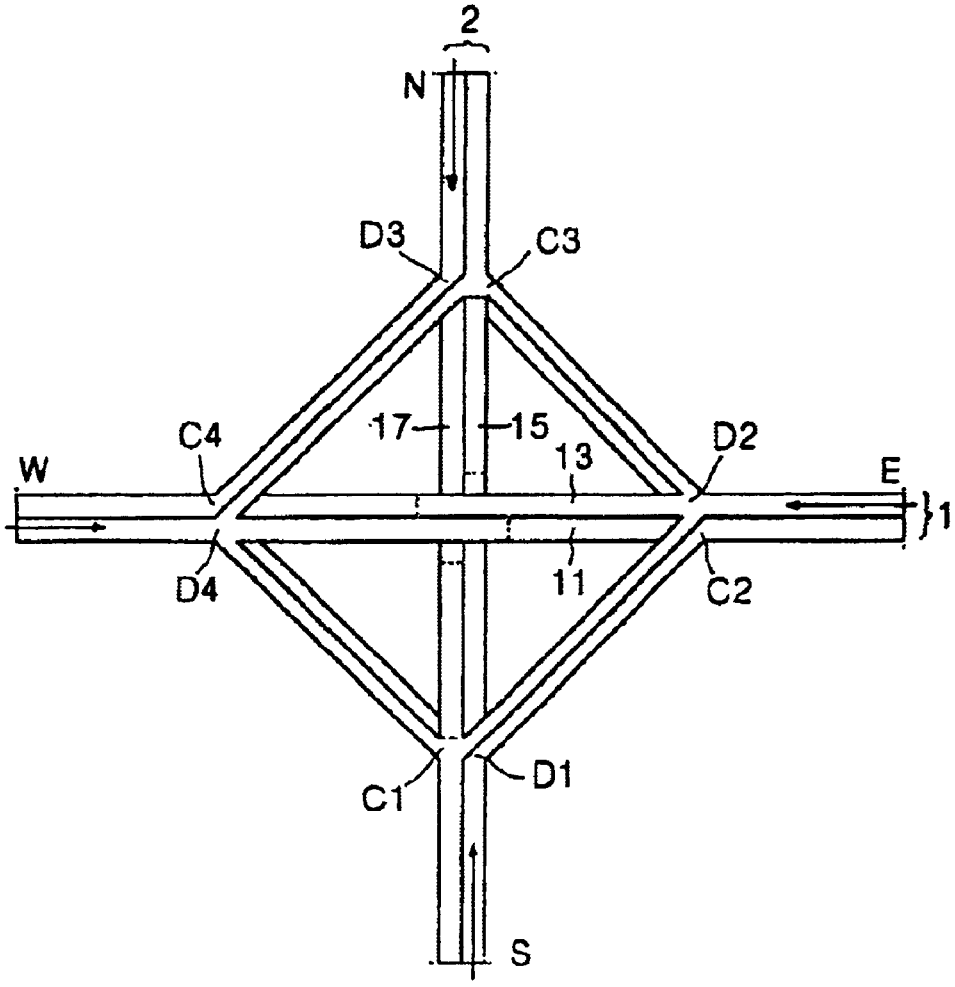
FIG. 2 is a plan view of FIG. 1.

FIGS. 1 and 2 are respectively a perspective and a plan view of Embodiment 1 of System 1.

Example 1 comprises main roads 1 and 2, which intersect each other. At the areas where one-way roads 11, 13, 15, and 17, which constitute main road 1 and 2, enter the intersection, such diverging sections as D1, D2, D3, and D4 are prepared where these one-way roads can diverge in three, that is, for the right and left turns aside from the way straight onward. In the areas at the other end, where the main roads depart from the intersection, are prepared converging sections C1, C2, C3, and C4, for what have branched off from the other one-way roads at their diverging sections. At one diverging section, to repeat, the road splits in three directions, one for the right turn, a second for the left turn, and a third, the central that extends straight onward.

Each of the above one-way roads 11, 13, 15, and 17 is built in an upper level road at one of the diverging sections D1, D2, D3, and D4, and in a lower level road at one of the converging sections C1, C2, C3, and C4 at the other, opposite end. Take WE for example. Its one-way road 11 is built on the upper level, and its one-way road 13 is on the lower level, both at D4. One-way road 11, on the upper level at D4, as said above, slopes downward when it passes the center of the intersection, and becomes a lower level road at C2.

The roads are built in such a way that each one-way road embody a sloping section at the center of the intersection between the converging sections C1, C2, C3, and C4 on the one hand and the diverging sections D1, D2, D3, and D4 on the other If main road 1 is on the upper level at the center of the intersection, main road 2 takes the lower level, while if main road 2 is on the upper level at the center, then main road 1 is on the lower level.

Accordingly main roads 1 and 2 are built so as to have a difference in height of more than that of an automobile where they intersect each other at the center.

Entrance roads 21~28 each meet, at the converging sections C1, C2, C3, and C4, with the one-way roads of the other main road (intersecting their own main road), which run in the same direction.

For instance, Entrance road 21 SE of one-way road 15 is connected at C2 with one-way road 11 WE of main road 1 intersecting one-way road 15, from which Entrance road 21 diverges for the right turn.

The main roads on the upper level can take variant shapes to suit the convenience of building the piers. For instance, they can be arches, or their two one-way roads can be separate from each other, with space in-between, at the center.

Now explication of actual traffic of automobiles through the system of the present invention follows:

Assume a car running on one-way road 11 in the WE direction. If it turns right, it enters Entrance road 26 at D4. It immediately reaches C1 of one-way road 17 in NS direction. If, however, it turns left, it enters Entrance road 27 at D4, and it reaches C3 of one-way road 15 in SN direction. And if it wants to go straight onward it simply will proceed by one-way road 11 in WE direction. At the other three points, a car can also take similar choices.

Figure 33:
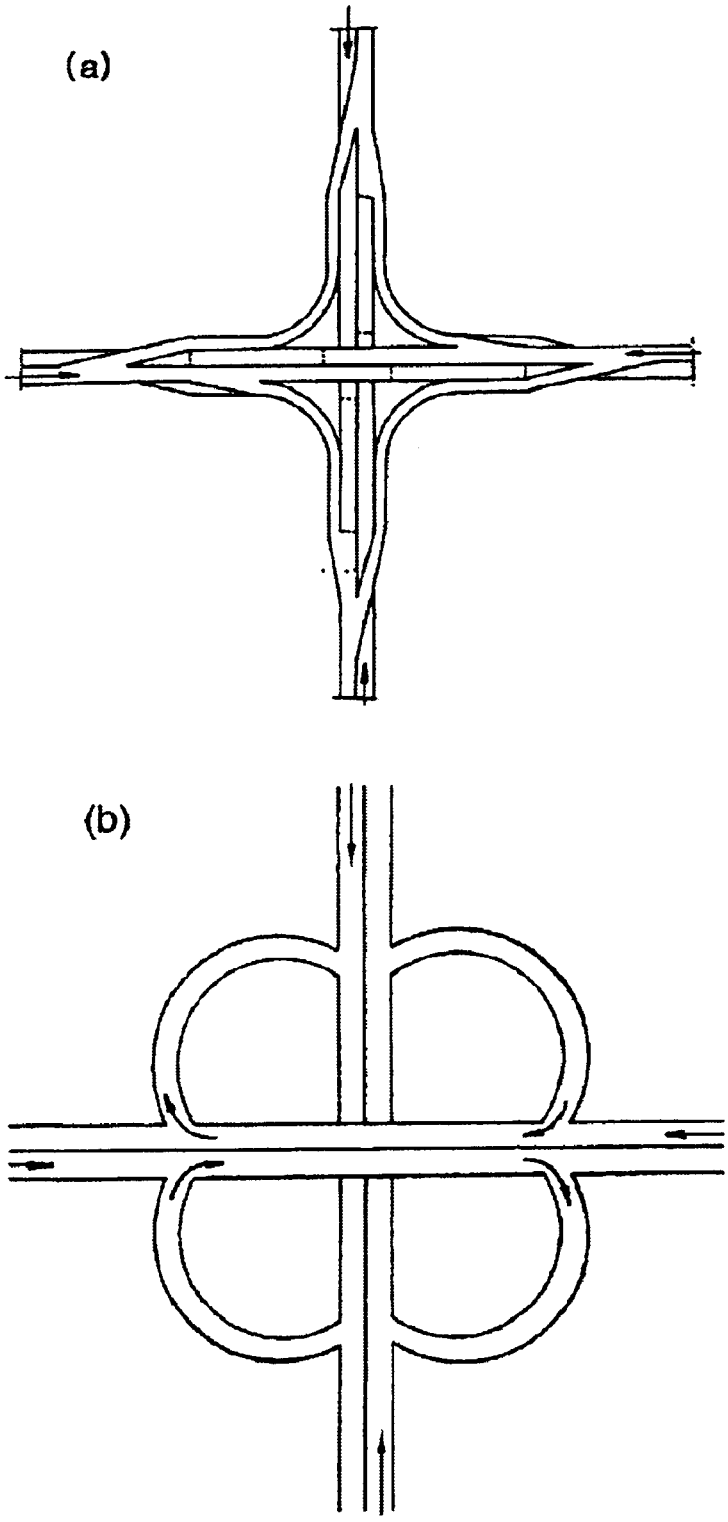
FIG. 33 is a plan view illustrating the sizes of land to be occupied respectively by (a) System 1 of the present invention and (b) a conventional cloverleaf intersection for comparison.

By passage in such ways automobiles can take their desired courses without having to wait for the lights. This way the size of land to be occupied by an intersection system can be considerably economized, taking less than one tenth what is required when building a cloverleaf structure. This will be schematically seen in FIG. 33. Because a driver is always required to take the left side entrance road from whatever position if he wants a left turn, and to take the right side entrance road if he wants a right turn, with no exception, there will be no confusion.

Moreover, a system like this can take many a varied styles accordant with the different circumstances and conditions of an intersection.

Figure 3:
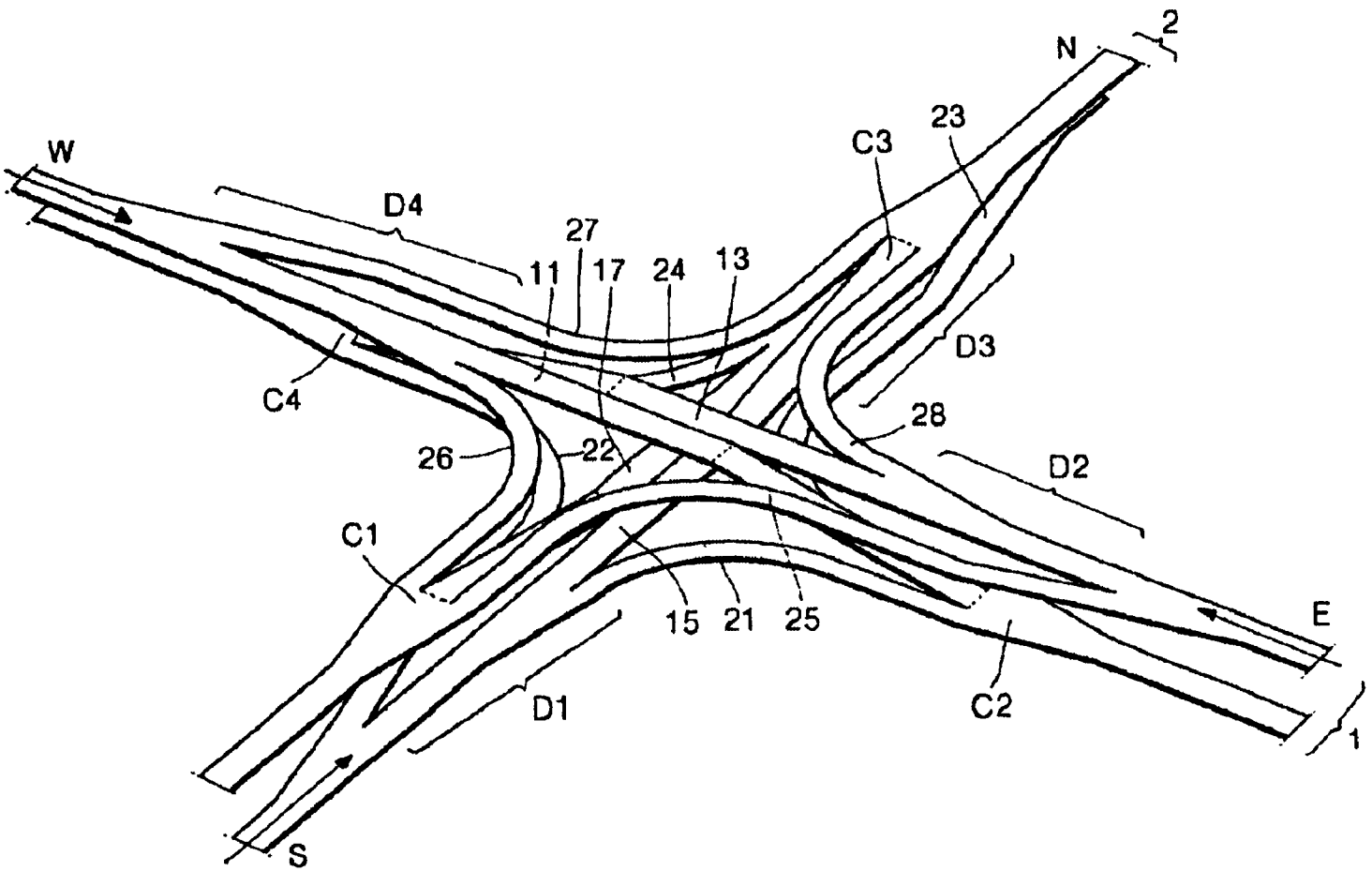
FIG. 3 is a schematic perspective view of a second embodiment of System 1 of the present invention.
Figure 4:
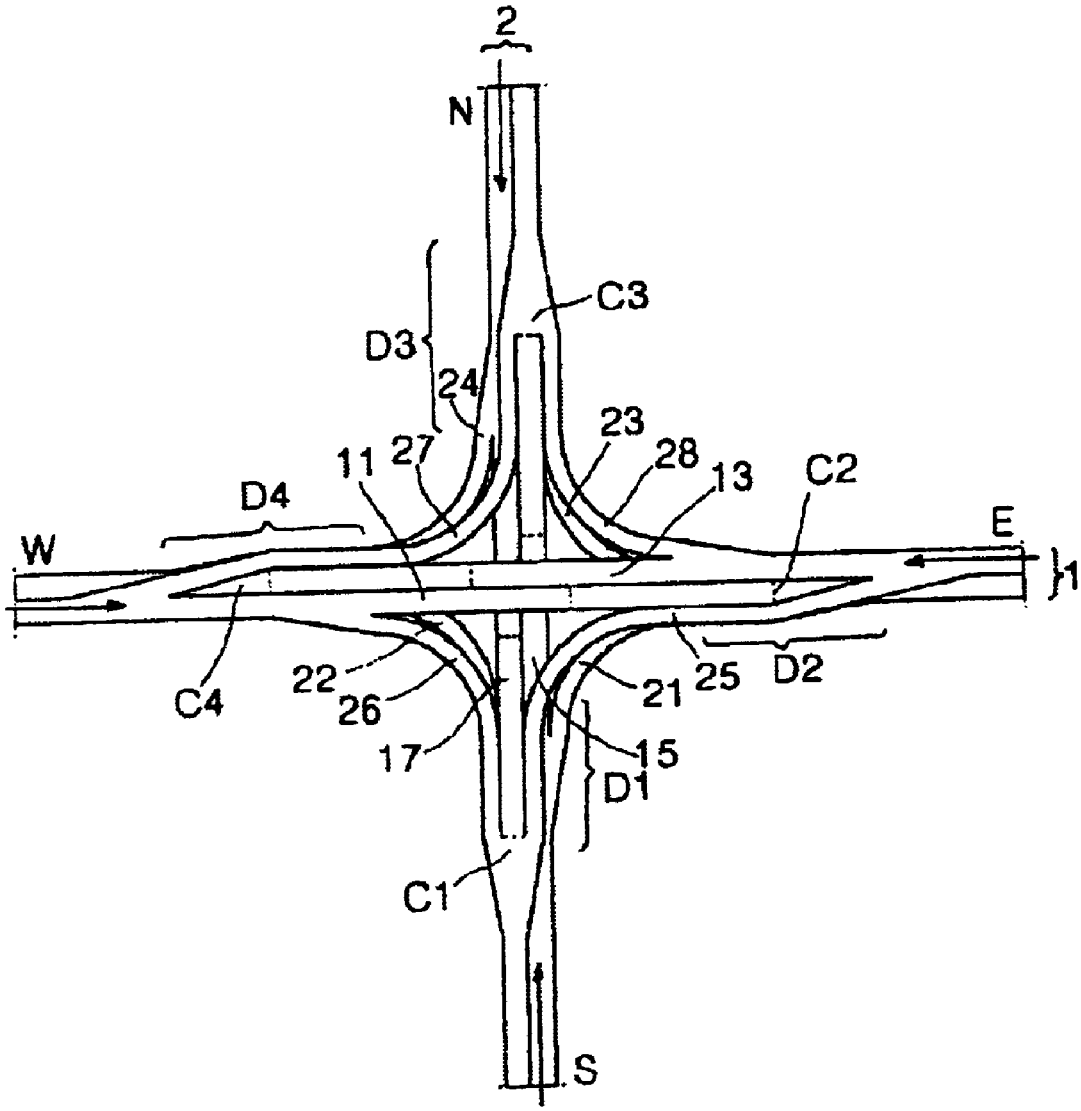
FIG. 4 is a plan view of FIG. 3.

FIGS. 3 and 4 are the perspective and plan views of a second embodiment of System 1 of the present invention.

In this embodiment each of Entrance roads 21~28 is shaped in the form of an arc a little bulged out inwardly. The radius of curvature of such an arc can be decided upon accordant with the speed allowed to the automobiles and sizes of land to be allotted to such an intersection system, but, in general, the smaller curvature the better, in terms of exploitation of land.

For the cars to secure the desirable height for passage through the main roads it will prove preferable that Entrance roads 21~28 be not required to pass over, the sloping sections of main roads. For instance, Entrance road 27, the left hand entrance road of one-way road 11, diverges before the right hand Entrance road 26 does, in order to secure a space higher than the height of a car between it and the sloping section of One-way road 13 which passes beneath it. Meanwhile, in FIG. 3, each entrance road is indicated to be connected at the same position at the converging section, but it may of course be so arranged that they may be connected at slightly different positions there if it is feared that otherwise there may result a congestion of cars.

Figure 5:
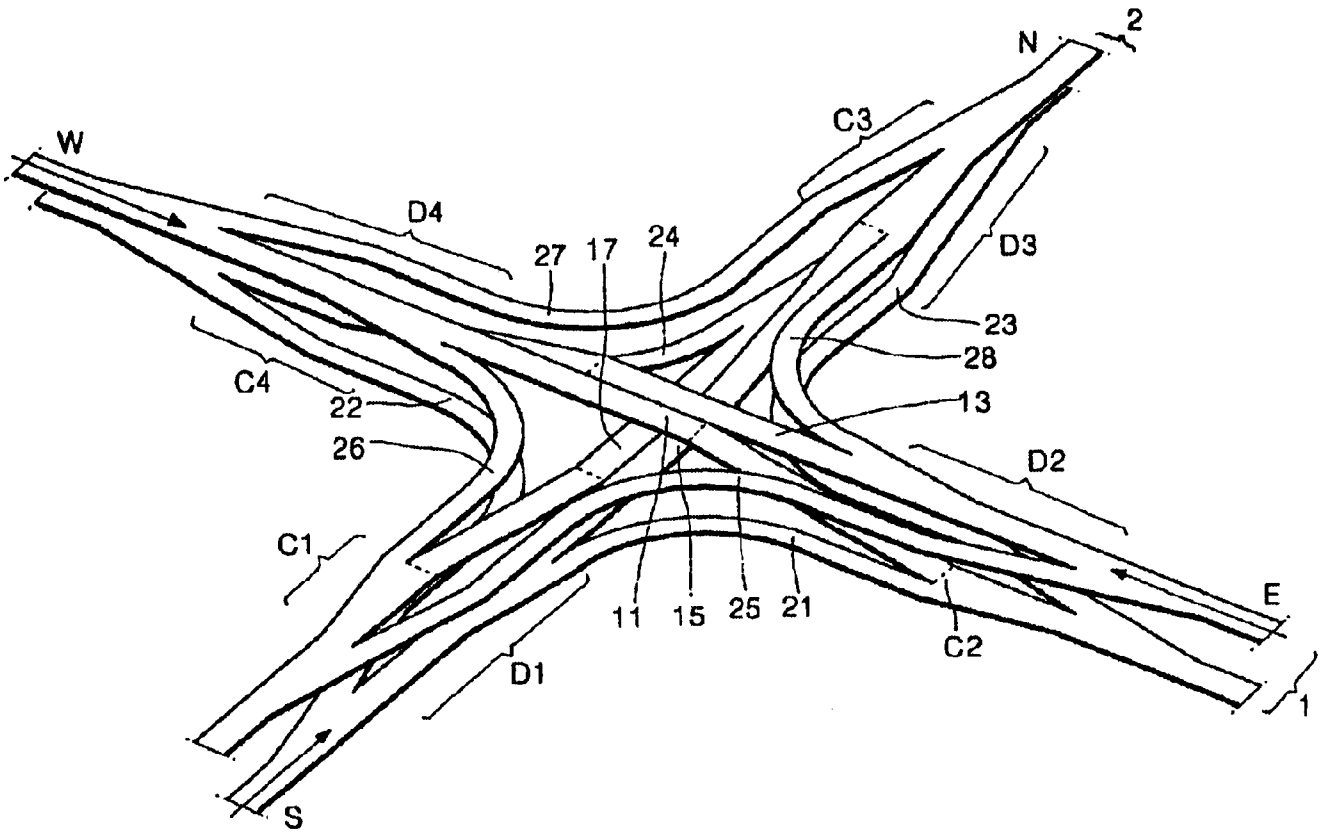
FIG. 5 is a schematic perspective view of a third embodiment of System 1 of the present invention.
Figure 6:
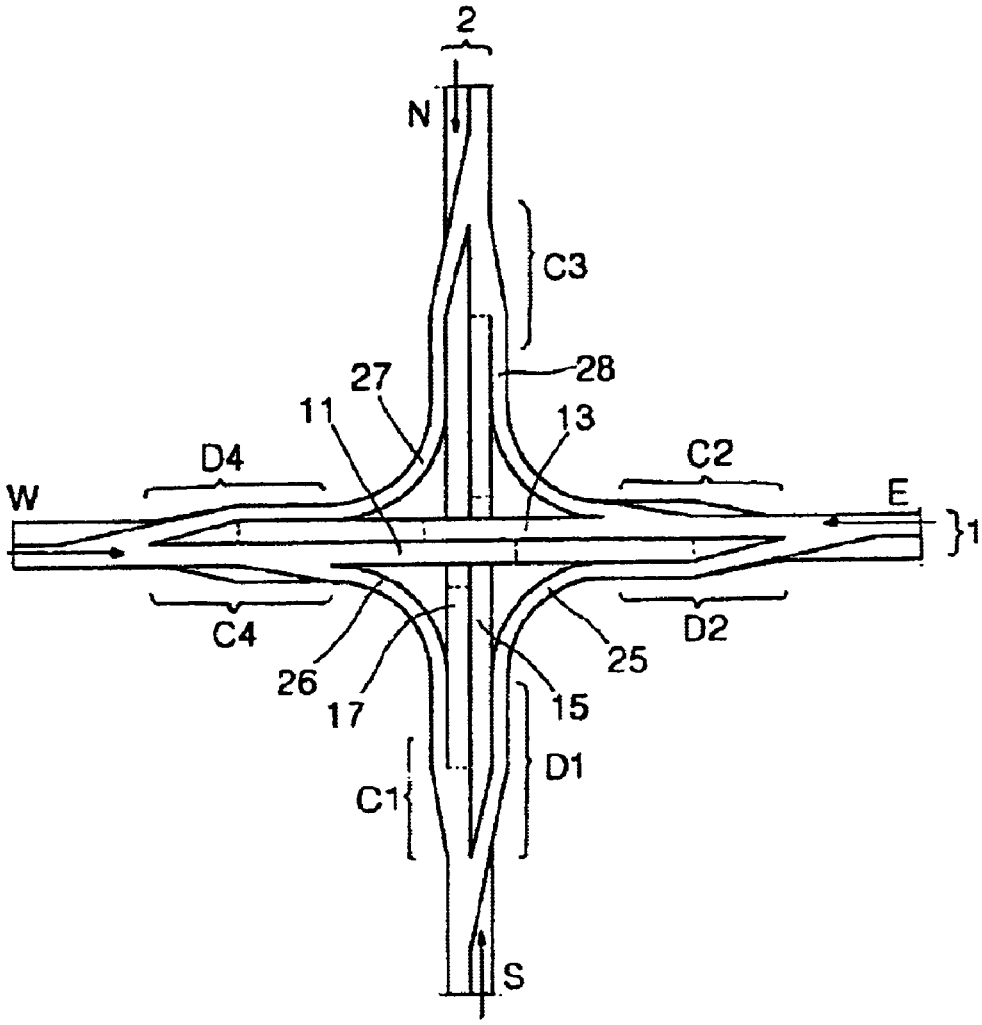
FIG. 6 is a plan view of FIG. 5.

FIGS. 5 and 6 are the perspective and plan views of a third embodiment of System 1 of the present invention.

When FIGS. 4 and 6 are compared it will be seen that, in this example, Entrance roads 25, 26, 27, and 28 of the upper level roads on the one hand and the arc parts of Entrance roads 21, 22, 23, and 24 on the other hand, somewhat overlap, when seen from above. This way, the land to be occupied by this intersection system may possibly be economized yet a little more.

Figure 7:
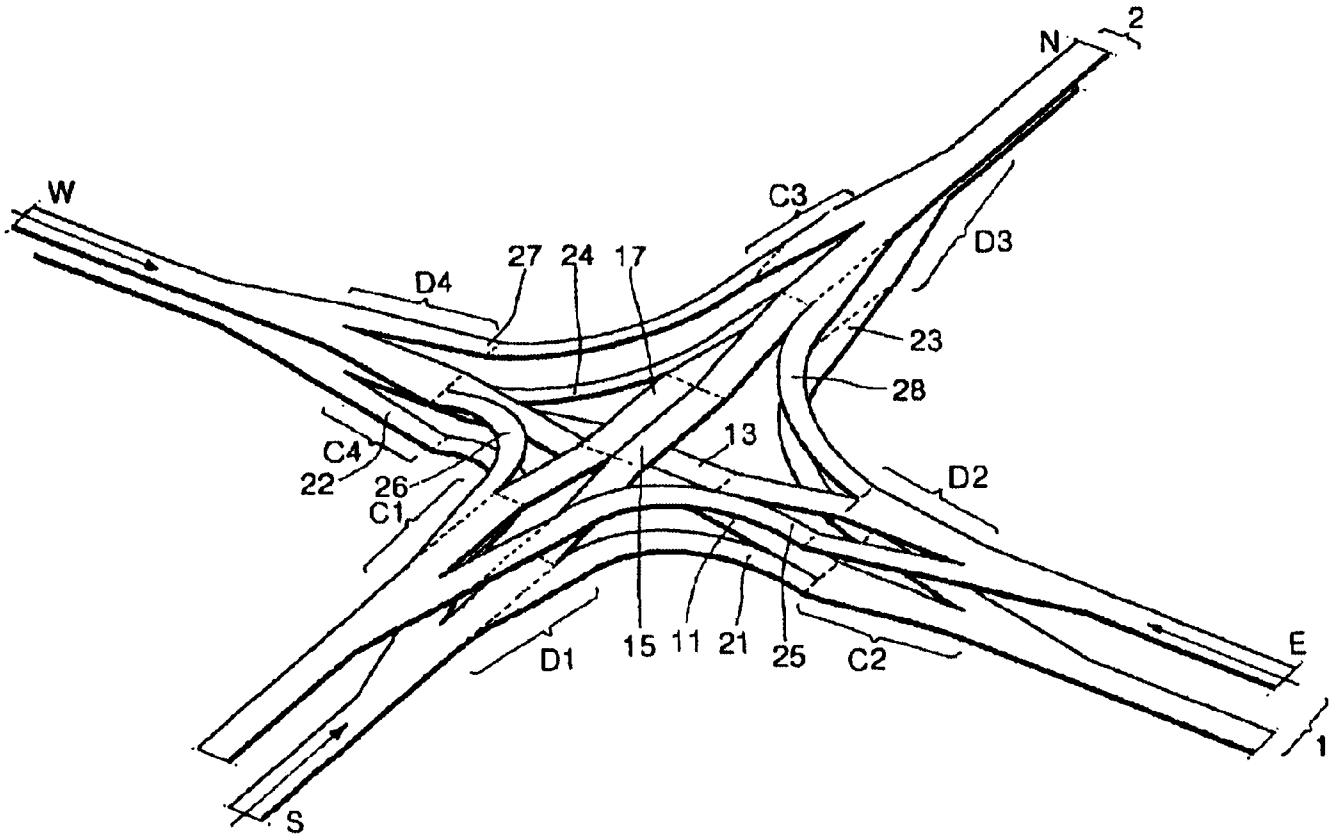
FIG. 7 is a schematic perspective view of a fourth embodiment of System 1 of the present invention.
Figure 8:
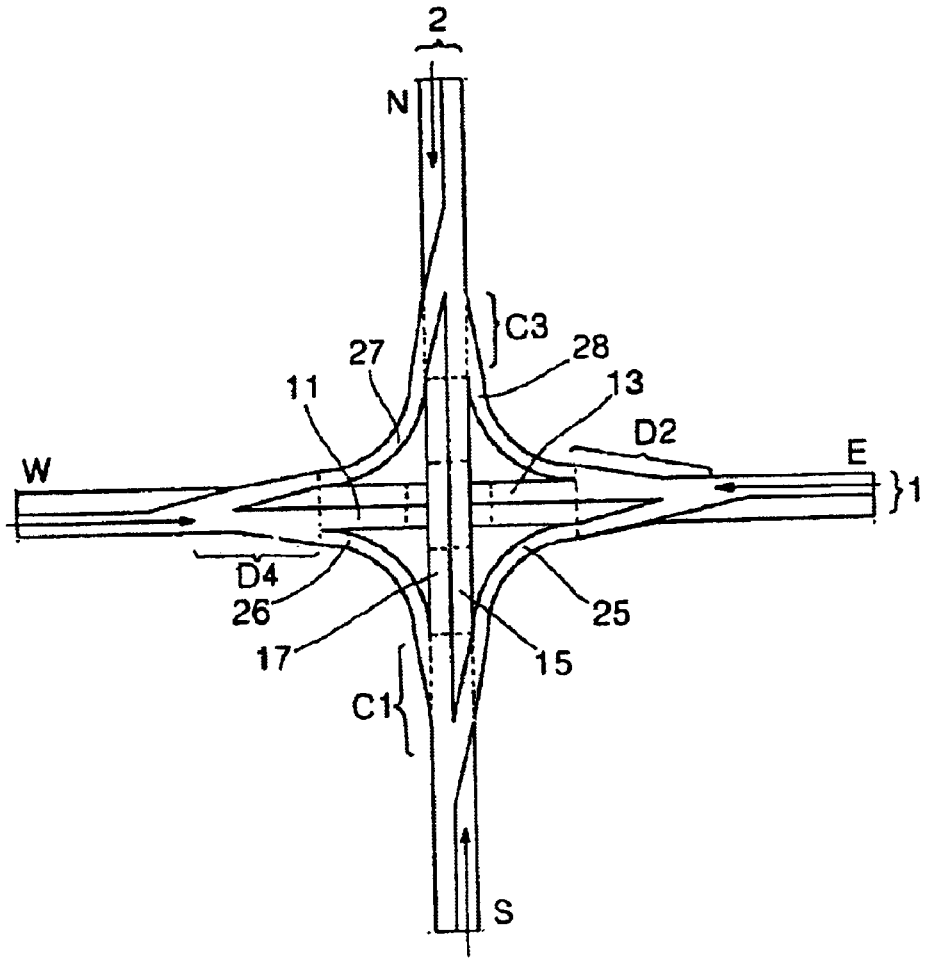
FIG. 8 is a plan view of FIG. 7.

FIGS. 7 and 8 are the perspective and plan views of a fourth example of System 1 of the present invention.

In this example, Entrance roads 21~28 each embody a sloping section, and of the upper level roads, the north and south portion is built higher than the east and west portion. Similarly, in the lower level roads, too, the north and south portion is built higher than the east and west portion. Accordingly, the length of the sloping sections to secure a certain desired height can also be minimized and shortened by no less than one half at maximum.

Figure 9:
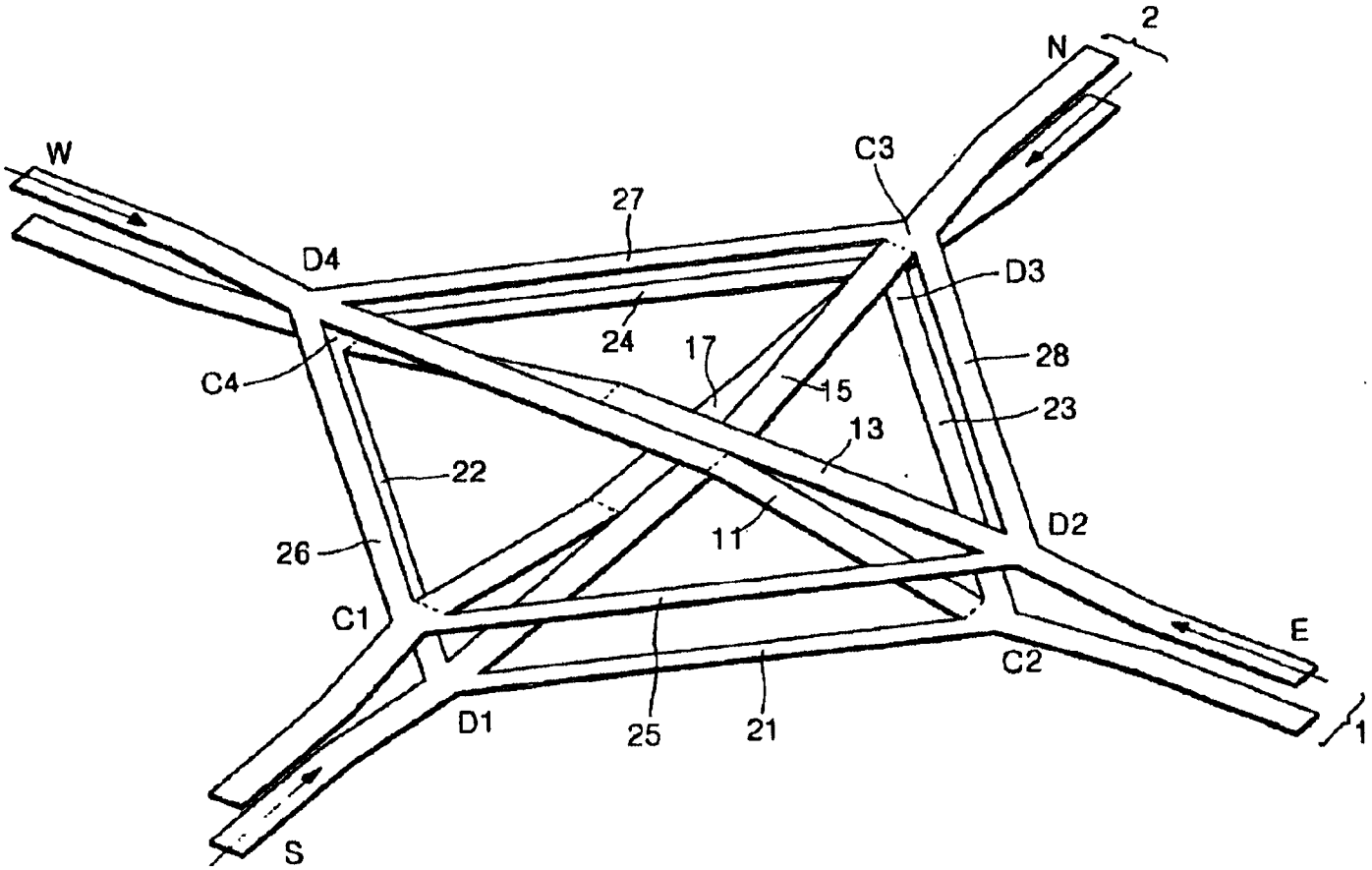
FIG. 9 is a schematic perspective view of a fifth embodiment of System 1 of the present invention.
Figure 10:
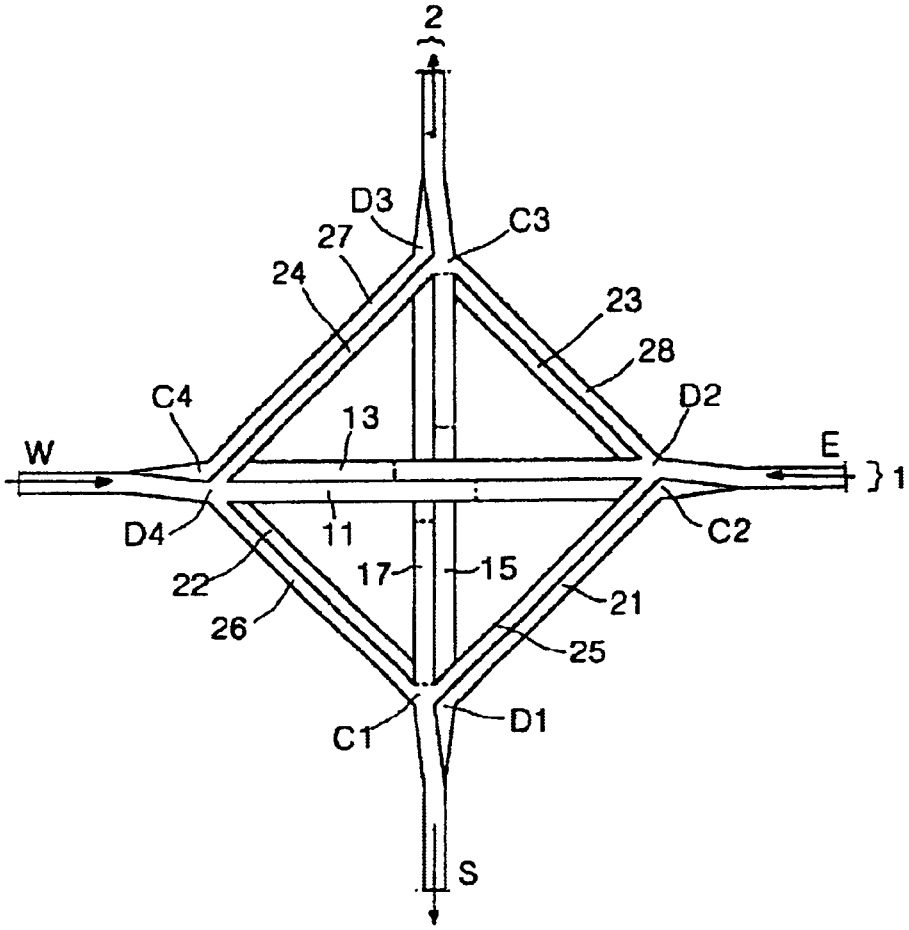
FIG. 10 is a plan view of FIG. 9.

FIGS. 9 and 10 are the perspective and plan views of a fifth example of System 1 of the present invention.

In this example, the four one-way roads, 11, 13, 15, and 17, which constitute main roads 1 and 2, are curved near the diverging sections D1, D2, D3, and D4, or at the converging sections C1, C2, C3, and C4, towards the breadth of the roads, so that they are built in a way that they will appear to overlap with others on the outside of the intersection, if seen from plan view.

In this example, again, it is possible to diminish the land occupied by main roads 1 and 2 at the outside of the intersection.

Figure 11:
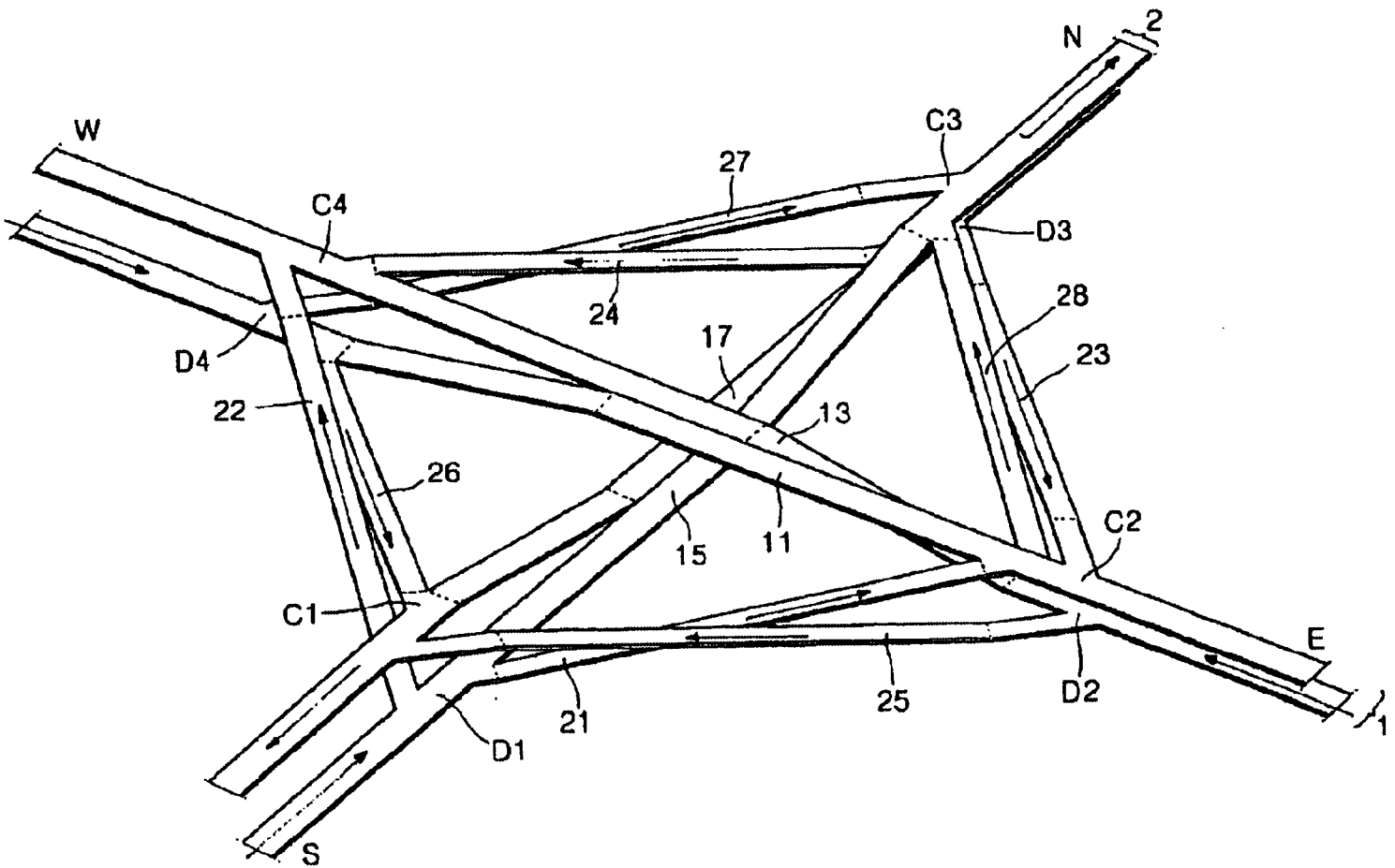
FIG. 11 is a schematic perspective view of a sixth embodiment of System 1 of the present invention.
Figure 12:
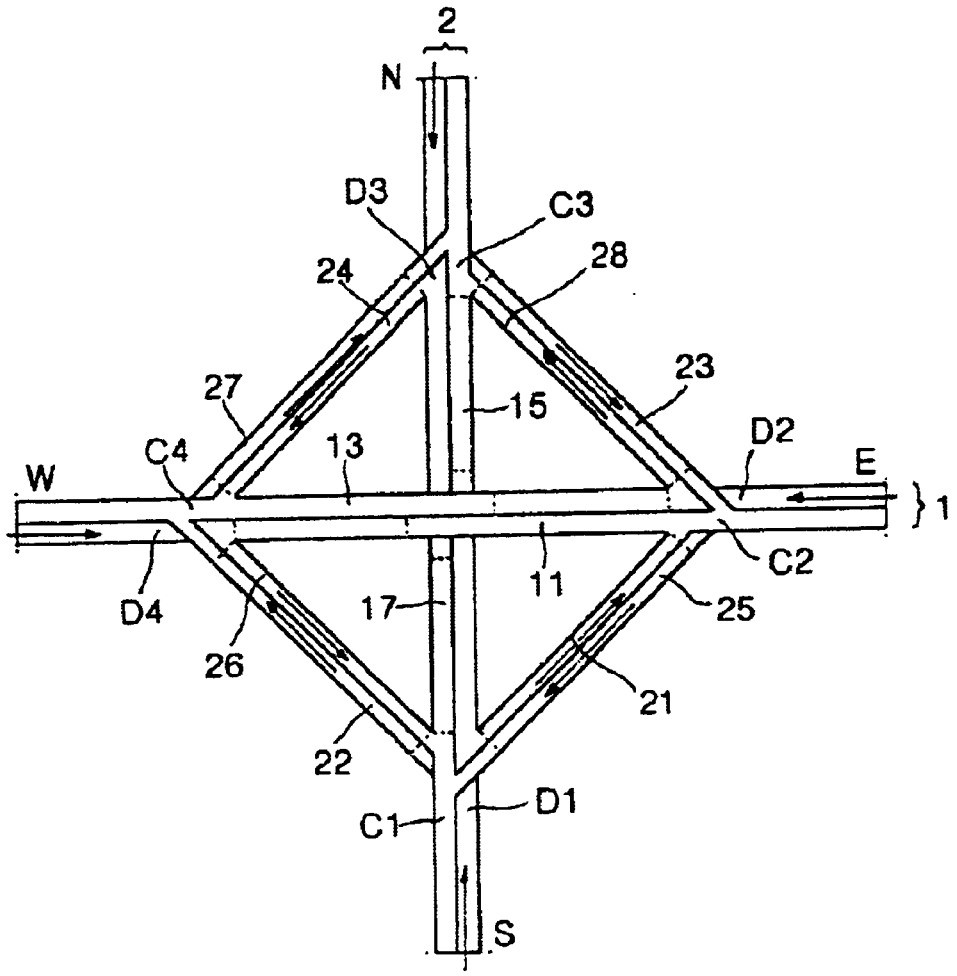
FIG. 12 is a plan view of FIG. 11.
Figure 13:
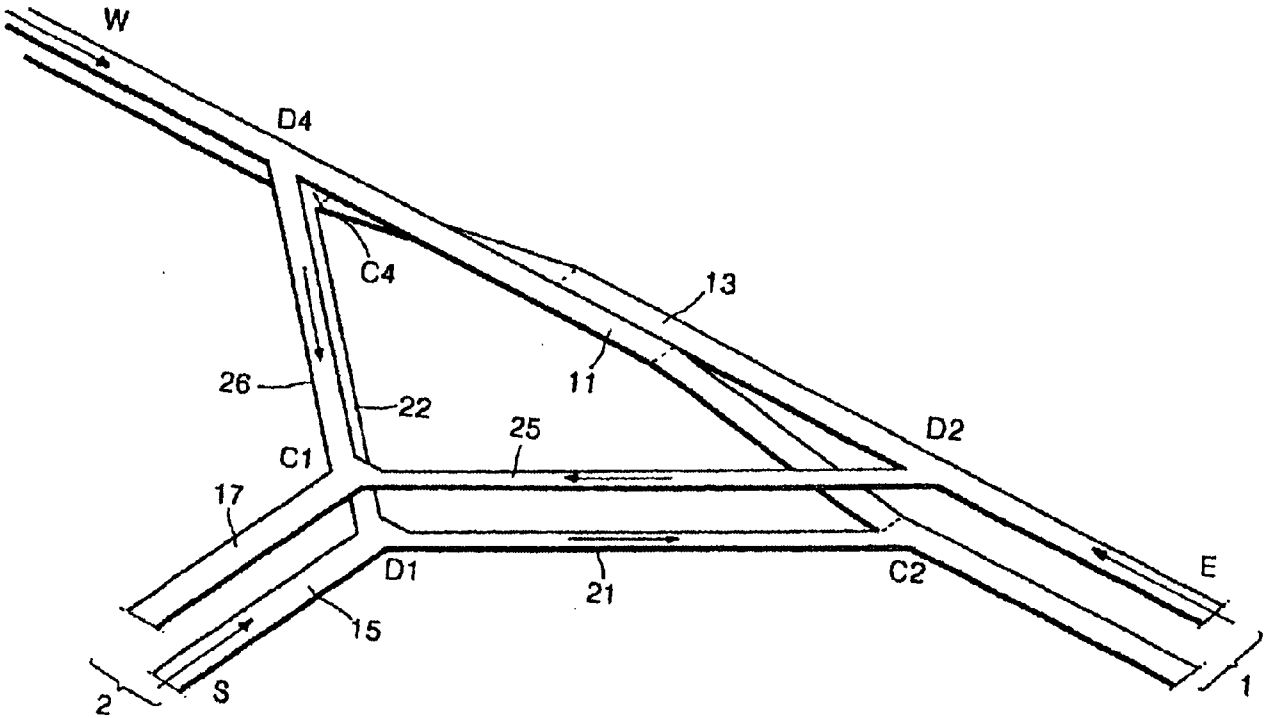
FIG. 13 is a schematic perspective view of a variation of System 1 of the present invention adapted for use for a 3-way intersection.
Figure 14:
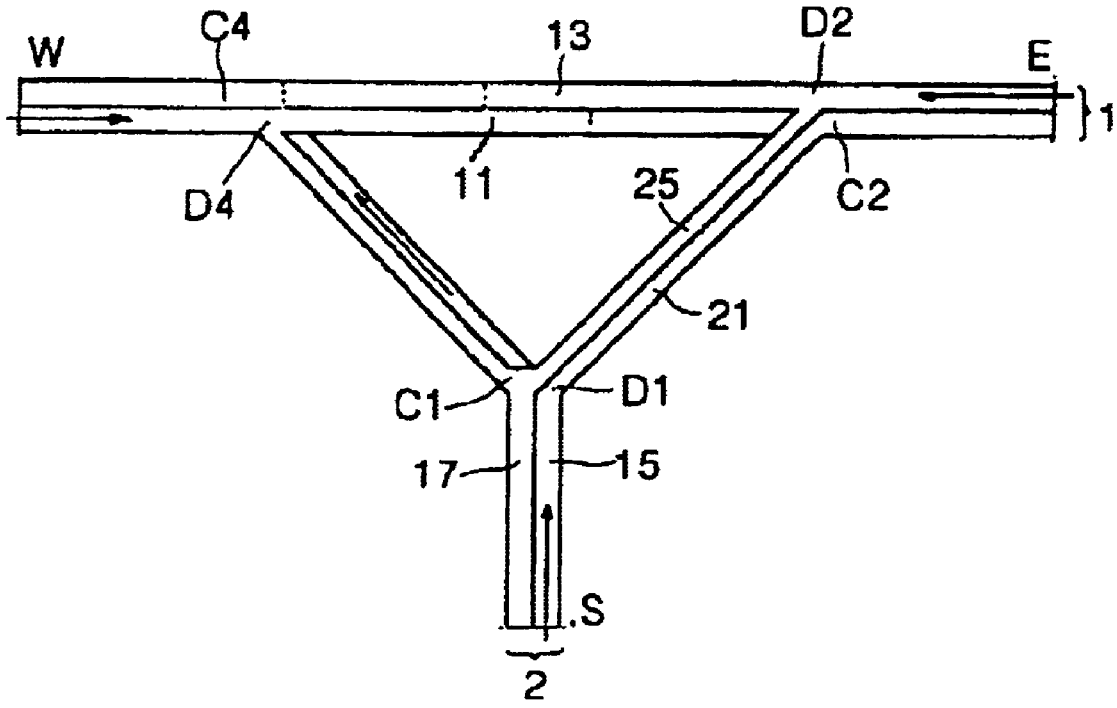
FIG. 14 is a plan view of FIG. 13.

FIGS. 11 and 12 are the perspective and plan views of a sixth example of System 1 of the present invention.

In this example, those of Entrance roads 21~28 are in a manner in which if they diverge on the lower level they converge on the upper level, while if they diverge on the upper level they converge on the lower level. For instance, Entrance road 26 in WE direction takes the lower level at D4 and converges at C1 on the upper level when exiting to be connected with one-way road 17. This way Exits 21~28 each embody a sloping section.

Meanwhile, all the above examples are for 4-way intersection, but they may be safely applied to 3-way intersections also.

For illustration take FIG. 1, and main road 1 as the basis. Imagine that only one part of the intersection system exists, and the two one-way roads, 15 and 17, which constitute main road 2, are each connected only between D1 and C1. Then you have an application of this embodiment to a 3-way intersection. In other words, the one one-way road of the two that constitute main road 2, which enters the intersection, extends only so far as the diverging section D1, and one-way road 17 extends only so far as the converging section C1, while at the diverging sections D2 and D4 of the two one-way roads which constitute main road 1 there are only two entrance roads, that is, Entrance roads 25 and 26, either one or the other for each, and there are also only two entrance roads, Entrance roads 21 and 22, one each connected with the converging sections C2 and C4.

Meanwhile, if main road 1 is not of a straight line but the 3-way intersection is in the shape of a "V", it will be seen that this system can be applied to any form of a 3-way intersection. Also, a number of variations can be made use of in 3-way intersections, too, as is the case with a 4-way intersection.

Figure 34:
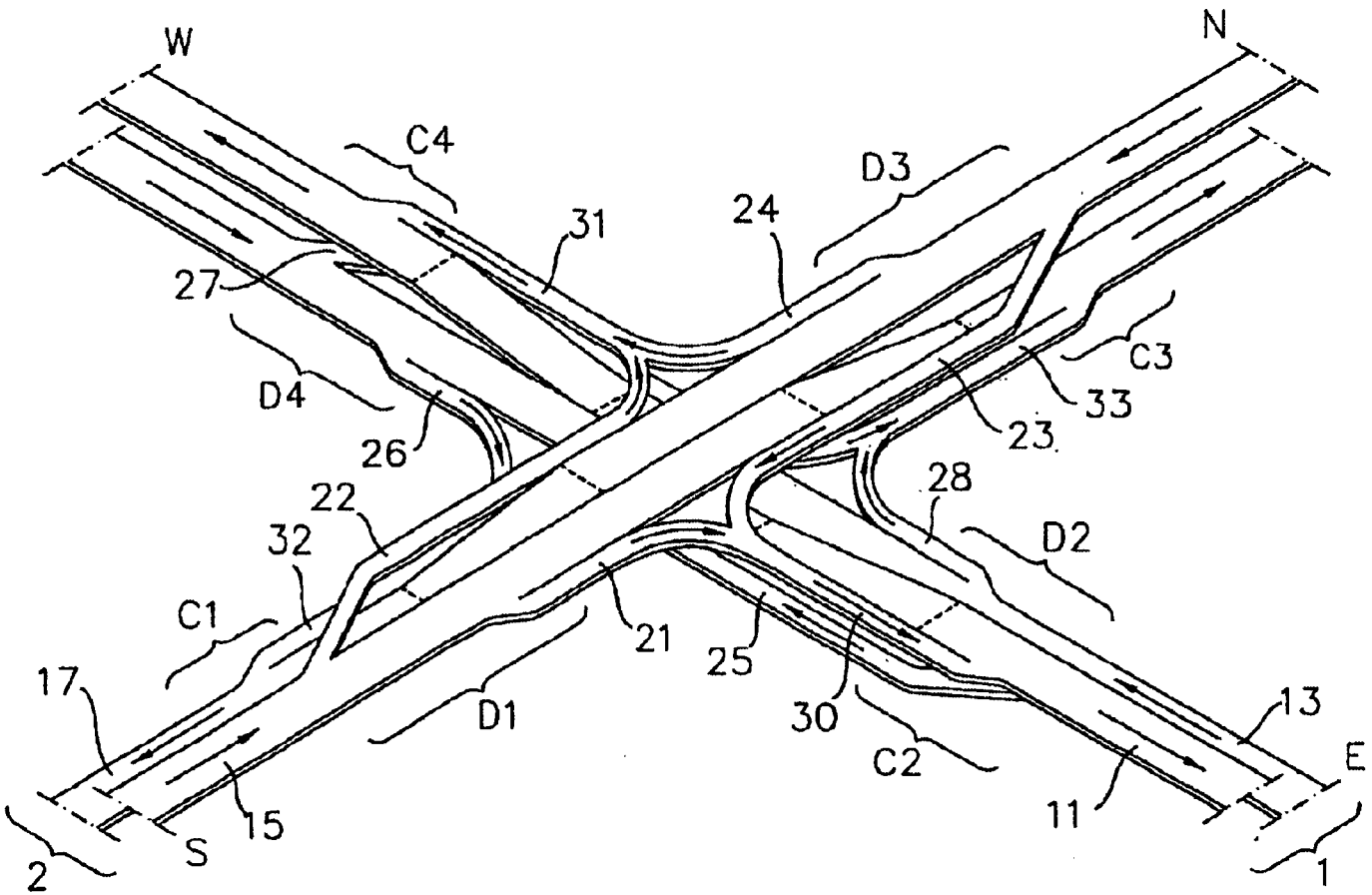
FIGS. 34 and 35 are perspective and plan views of a seventh example of System 1 of the present invention.
Figure 35:
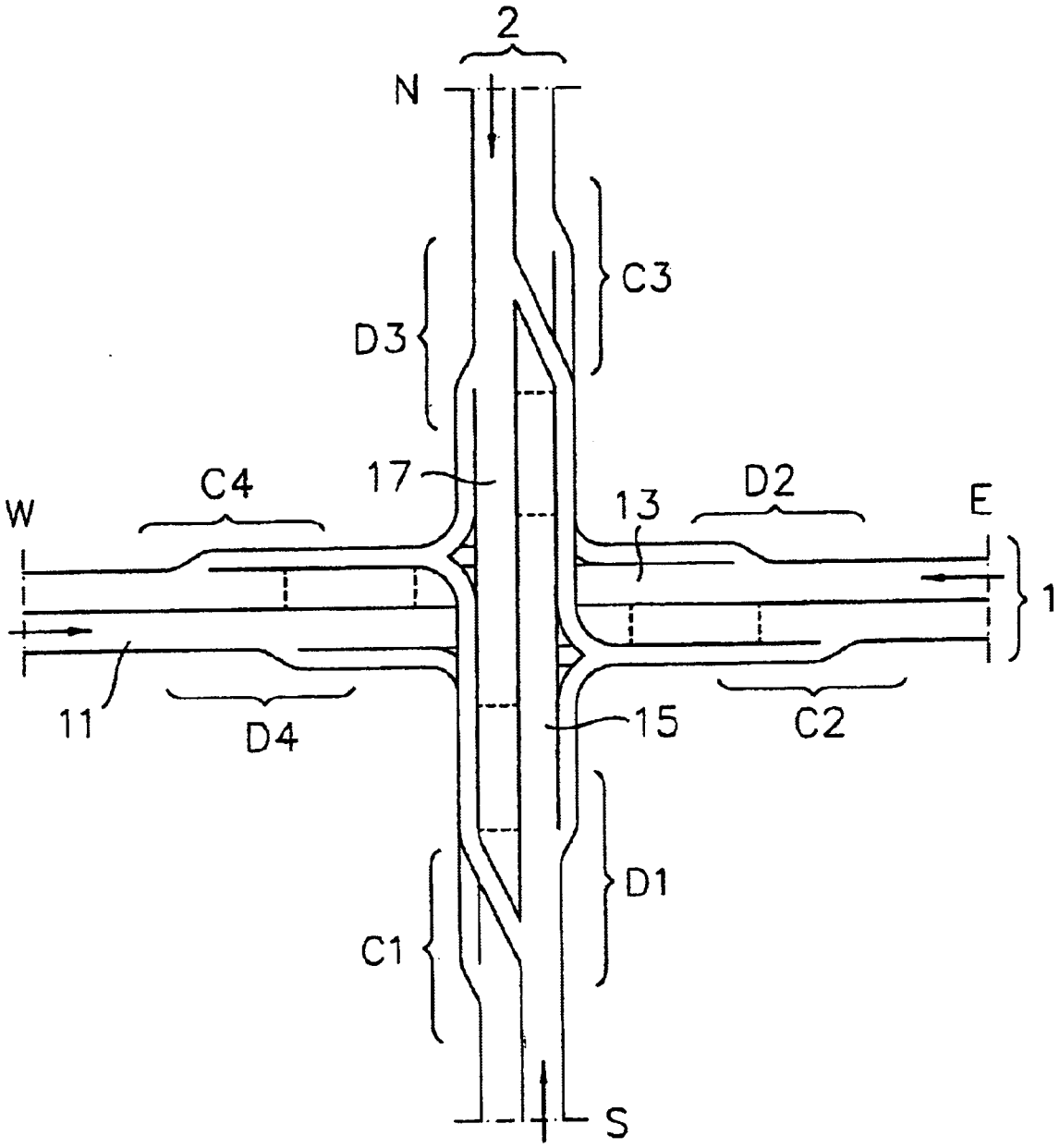

FIGS. 34 and 35 are perspective and plan views of a seventh example of System 1 of the present invention.

In this example, an entrance road for a right turn of a one-way road diverges, and of the main road including said one-way road, an entrance road for a left turn of the other one-way road diverges, respectively, after which are combined into one road. The entrance road combined as such is connected to the converging section of the one-way road of the other main road, the direction of which is that of the intended progression therefrom.

For example, in one-way road 15 of main road 2, entrance road 21 for a right turn form diverging section D1 diverges, and entrance road 23 for a left turn form diverging section D3 of the other one-way road 17 of the same main road 2 diverges, respectively, after which are combined into one road of entrance road 30, which is connected to converging section C2 of one-way road 11 of main road 1. This type of construction is the same for other one-way roads 11,13,17, other converged entrance roads 32,33 and 31. Hence, in regard to respective one-way roads, two entrance roads diverge, one to left and right, respectively, form the diverging section.

At the converging section, a combined entrance road only converges either from left or right. Consequently, the converging sections are simplified for smooth traffic.

Figure 36:
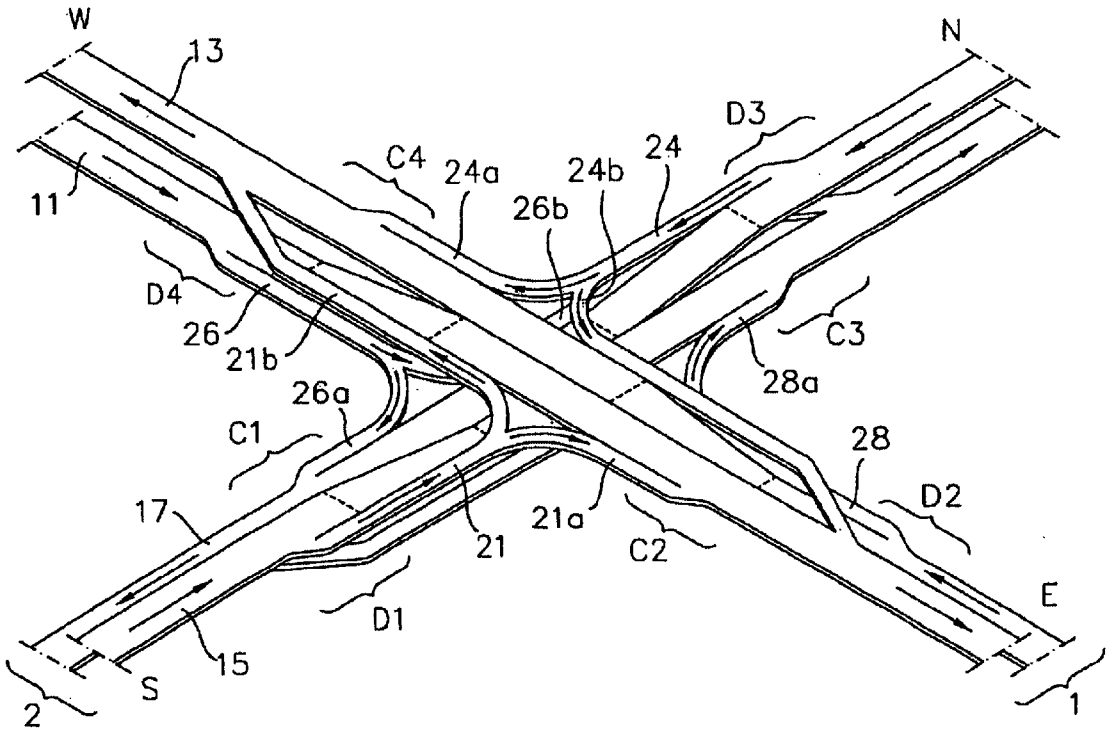
FIGS. 36 and 37 are perspective and plan views of an eighth example of System 1 of the present invention.
Figure 37:
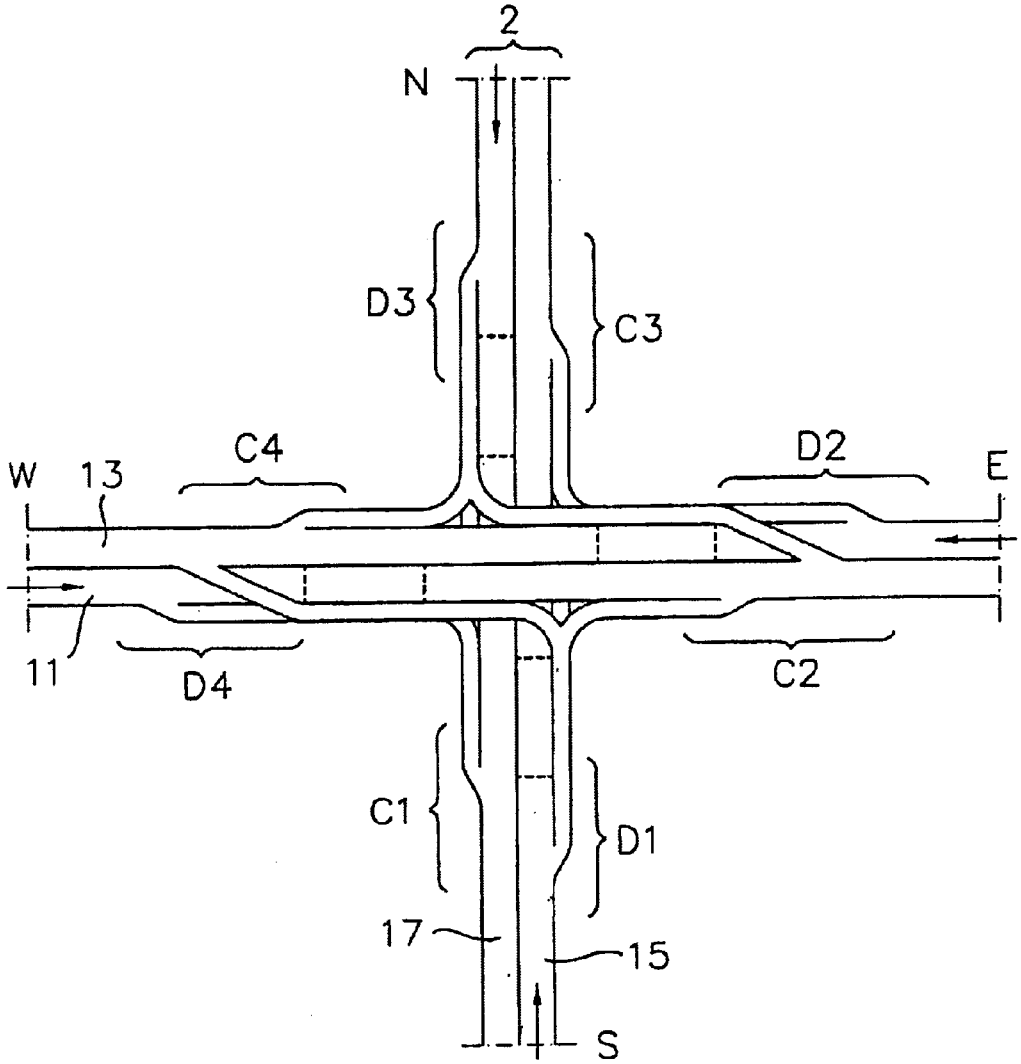

FIGS. 36 and 37 represent the perspective and plan views of an eighth example of System 1 of the present invention.

In this example, said entrance road, which has diverged form the respective diverging section of one-way road, is in itself diverged into two sub-entrance roads. These sub-entrance roads are connected, respectively, to the converging section of the two one-ways of the main road which is perpendicular to the one-way road including said entrance road.

In a case of progression into one-way 15 of main road 2, as an example, at diverging section D1, a progression for left and right turns is made into entrance road 21, which is situated on the right side of the one-way road 15. Thereafter, for the purpose of making a left turn, a progression is made into sub-entrance road 21*b* for converging into converging section C4 of one-way road 13. For the purpose of making a right turn, a progression is made into sub-entrance road 21*a* for converging into converging section C2 of one-way road 11. This type of construction is equally applicable to the cases where progressions are made into other one-way roads 11,13 and 17. Entrance roads can be connected to one-way roads, either to the right or left side thereof.

Consequently, at the point of diversion of the entrance road from the diverging section, there is an advantage in this case in that a diversion to the same direction could be made, either for a left or right turn.

2. System 2

Below, explanation of System 2 of the present invention follows, the drawings being referred to whenever deemed helpful.

Figure 15:
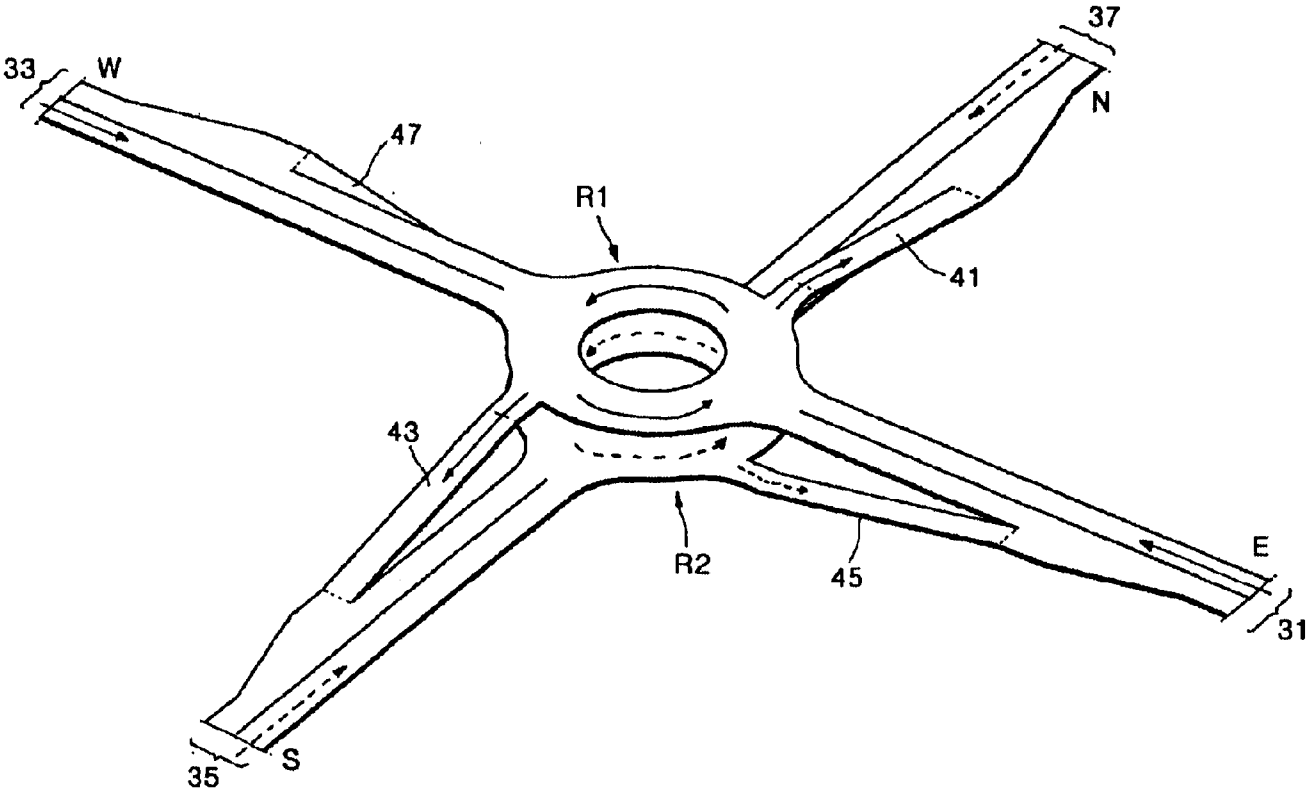
FIG. 15 is a schematic perspective view of an embodiment of System 2 of the present invention.
Figure 16:
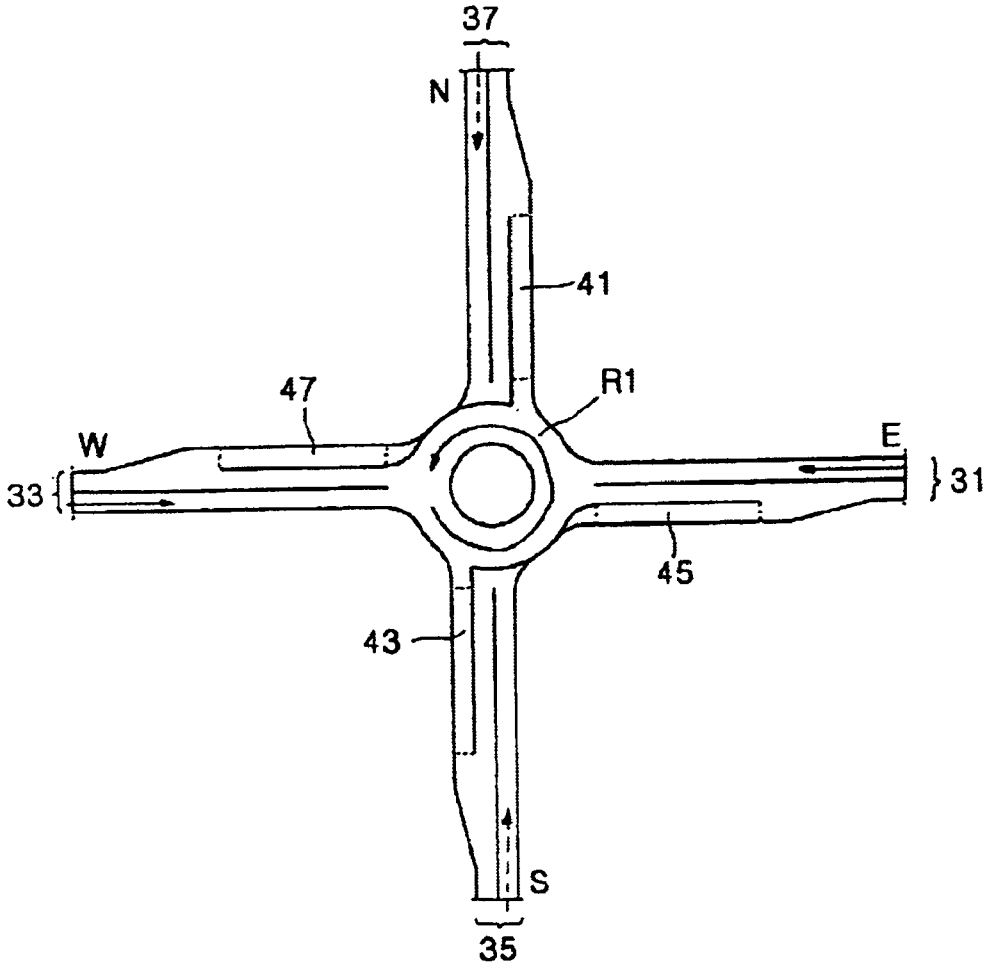
FIG. 16 is a plan view of FIG. 15.

FIGS. 15 and 16 are drawings to illustrate an example of System 2 of the present invention.

As is to be seen in the drawings, this example comprises of two ring-shaped roads R1 and R2, the former being built on the upper and the latter on the lower level.

To the outer circumference of the ring-shaped road R1 on the upper level are two half-main-roads, 31 and 33, connected in two given directions (in the west and east in the drawings) from the outside of the intersection; in the other direction (in the south and north in the drawings) are two entrance roads, 41 and 43, connected, respectively.

Likewise, to the outer circumference of the other ring-shaped road R2 on the lower level are two other half-main-roads, 35 and 37, connected respectively from the outside of the intersection in two given directions (in the south and north in the drawings), and in the other directions (in the east and west in the drawings) Entrance roads 45 and 47 are connected.

Then, in FIG. 16, half-main-roads 31 and 33 connected with the ring-shaped road R1 on the upper level, half-main-roads 35 and 37 connected with the ring-shaped road R2 on the lower level, Entrance roads 41 and 43 connected with the ring-shaped road R1 on the upper level, and Entrance roads 45 and 47 connected with the ring-shaped road R2 on the lower level take mutually different directions. In other words, in a plan view drawing, either half-main-road 31 or 33 does not overlap with either half-main-road 35 or 37, nor does either Entrance road 41 or 43 with either Entrance road 45 or 47.

Either one or more of the two one-way roads or entrance roads that constitute the half-main-road connected with each ring-shaped road embody a sloping section, and an entrance road is connected with any one of the one-way roads, of the half-main-roads on either the upper or lower level, which runs in the same direction as that of it. In other words, in relation with half-main-road 31 of the half-main-roads connected with the ring-shaped road R1 on the upper level, it is to be seen that Entrance road 45, emerging from the ring-shaped road R2 on the lower level in the direction of R2E, forms a sloping section and afterwards joins half-main-road 31 in the R1E direction. The same applies to the other half-main-roads and one-way roads, with necessary changes.

Now the ways of passage of automobiles in this intersection system will be explained.

In FIG. 15, imagine that a car enters the intersection by the one-way road of half-road 33 in the WR1 direction. Upon entrance in the ring-shaped road R1 the car just proceeds along the right side. If it wants to have a right turn it can just go on by Entrance road 43 which it is first to come to, but if it wants to go straight onward it just needs to turn further along the ring-shaped road R1 and advances on the one-way road of half-main-road 31 in the R1E direction. If it wants to make a left turn, then it needs to turn further to take Entrance road 41.

The passage in this way applies to the other cars entering from the other directions, too, and in fact to all traffic on both the upper and lower level ring-shaped roads.

Thus all traffic can proceed without interruption, wasting no time to wait for a light. Compared with conventional intersection with only one ring-shaped road, this double ring-road system can of course help solve the problem of traffic congestion a great deal more efficiently.

The size (diameter) of a ring-shaped road can be decided in consideration of the allowable speeds of cars, the size of land available for its construction, etc.

Meanwhile, a number of variations can be worked on System 2 of the present invention, too.

Figure 17:
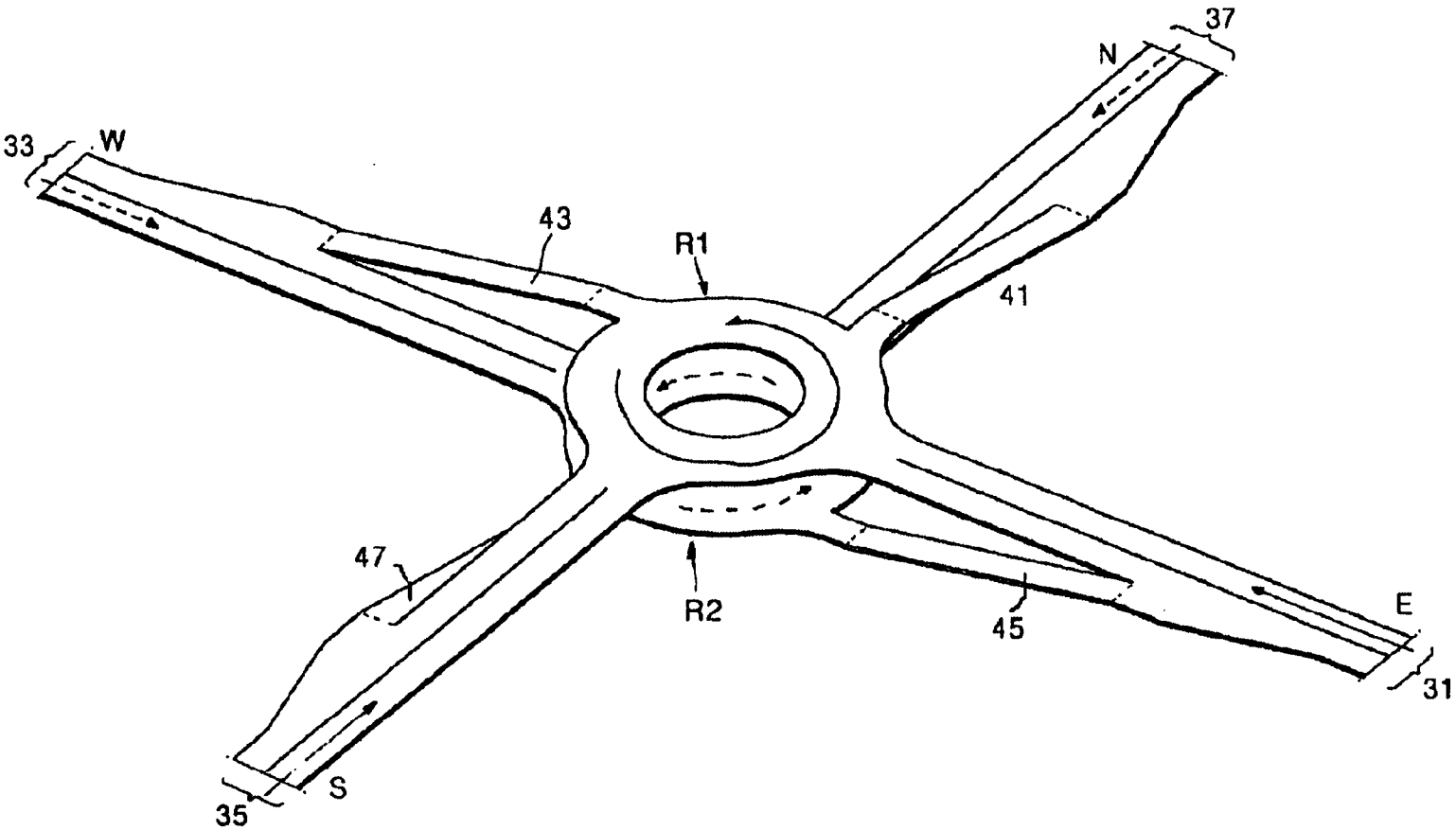
FIG. 17 is a schematic perspective view of a second embodiment of System 2 of the present invention.
Figure 18:
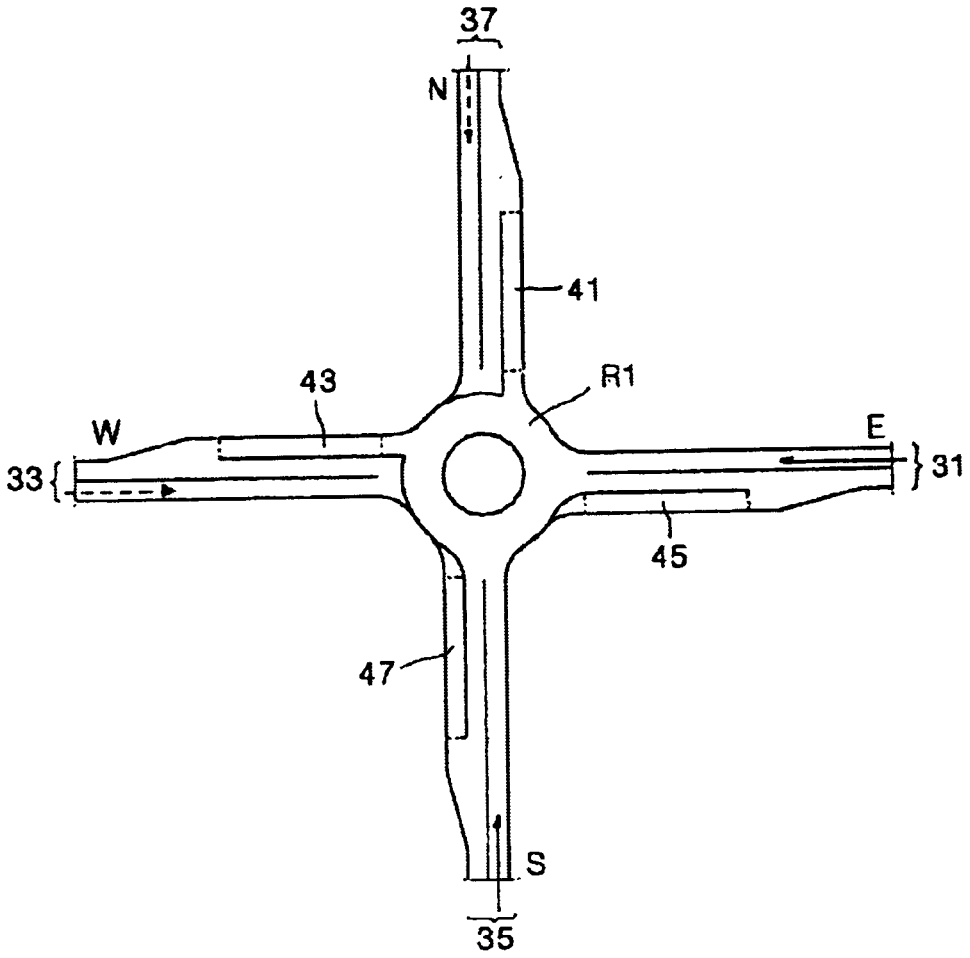
FIG. 18 is a plan view of FIG. 17.

FIGS. 17 and 18 are the drawings of a second example of System 2.

In FIG. 15 the angle formed by the two half-main-roads, 31 and 33, connected with the ring-shaped road R1 is 180° (that is, a straight line, in the plan view), but in this example the angle formed by the two half-main-roads, 31 and 35, is 90°. The direction in which a half-main-road and an entrance road are connected is not specifically defined, but the best of all is one, in which each ring-shaped road is made to dispose of about one half of total traffic.

Figure 19:
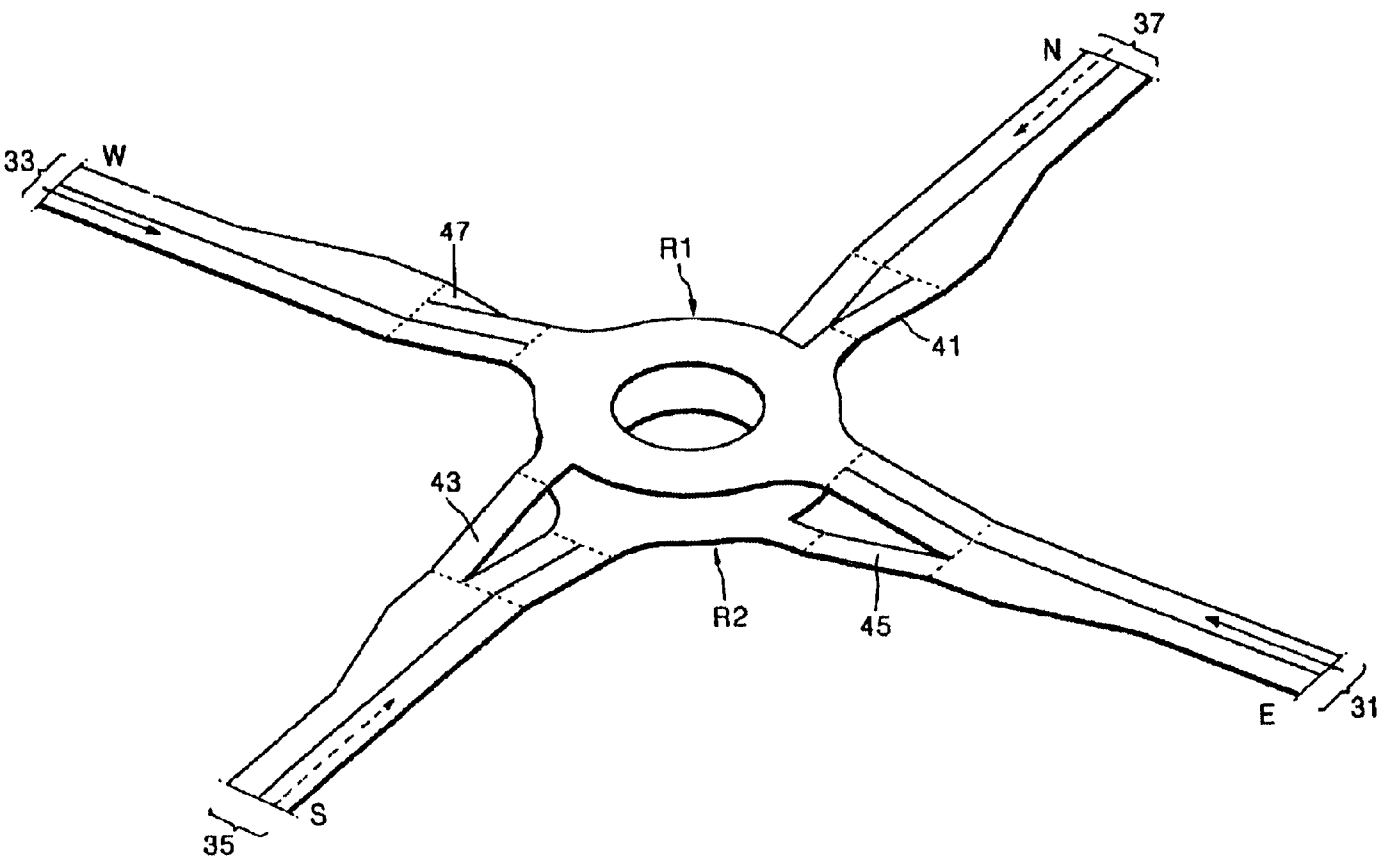
FIG. 19 is a schematic perspective view of a third embodiment of System 2 of the present invention.
Figure 20:
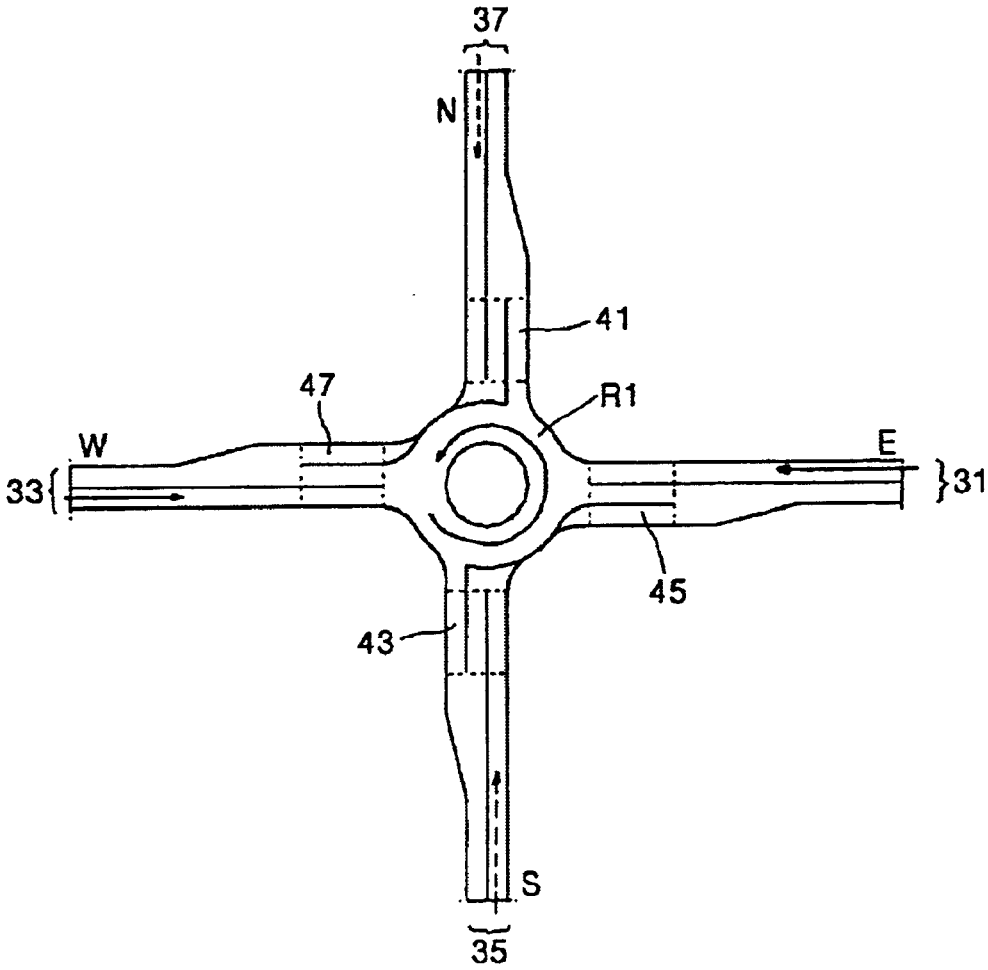
FIG. 20 is a plan view of FIG. 19.

FIGS. 19 and 20 are the drawings of a third example of System 2.

In the case of FIG. 17 above, the roads could be divided in accordance with their heights into upper level roads, lower level roads, and sloping sections. But FIG. 19 here is of a case, which has a section of the road of a medium-height between the upper and lower levels and is parallel with the surface of the ground. In this case, therefore, there are three different levels of the road parallel to the surface of the ground, when seen from the front, or from a side.

To elaborate, in FIG. 19, the four half-main-roads, 31, 33, 35, and 37, are on a medium height between the upper and lower levels at the outside of the ring-shaped roads. Half-main-roads 35 and 37 respectively have a downward sloping section as they near the ring-shaped road R2, and thereafter are connected with ring-shaped road R2, while half-main-roads 31 and 33, after each having an upward sloping section, are connected with ring-shaped road 1.

Accordingly, entrance roads 43 and 41, connected with half-main-roads 35 and 37 from the ring-shaped road R1, each have a downward sloping section, while entrance roads 45 and 47, connected with half-main-roads 31 and 33 from the ring-shaped road R2, each have an upward sloping section.

In such a construct, the gap between the upper and lower levels of the road can be made to secure a proper height of more than that of a car, and still the sloping sections can be made shorter in length than otherwise.

Figure 21:
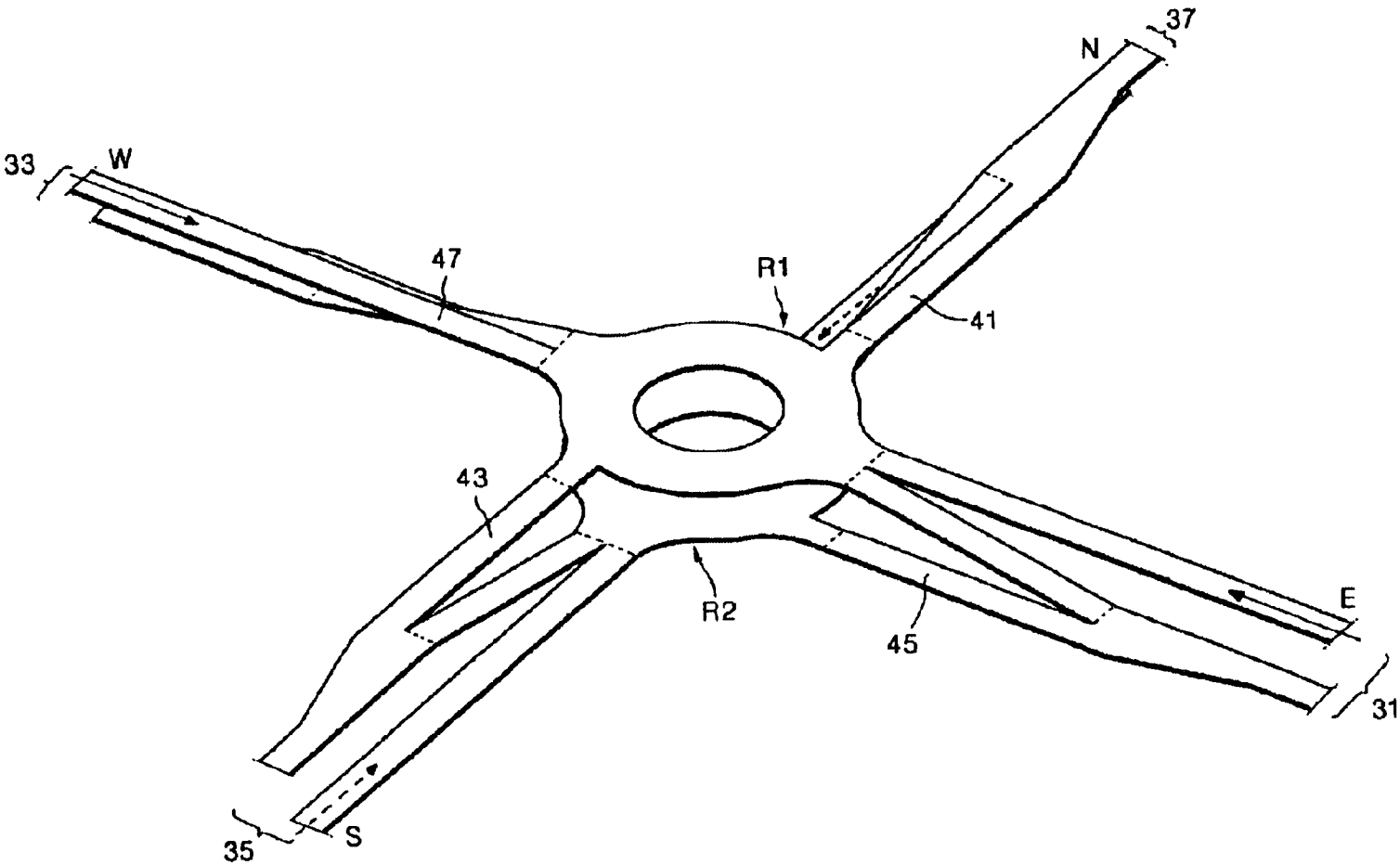
FIG. 21 is a schematic perspective view of a fourth embodiment of System 2 of the present invention.
Figure 22:
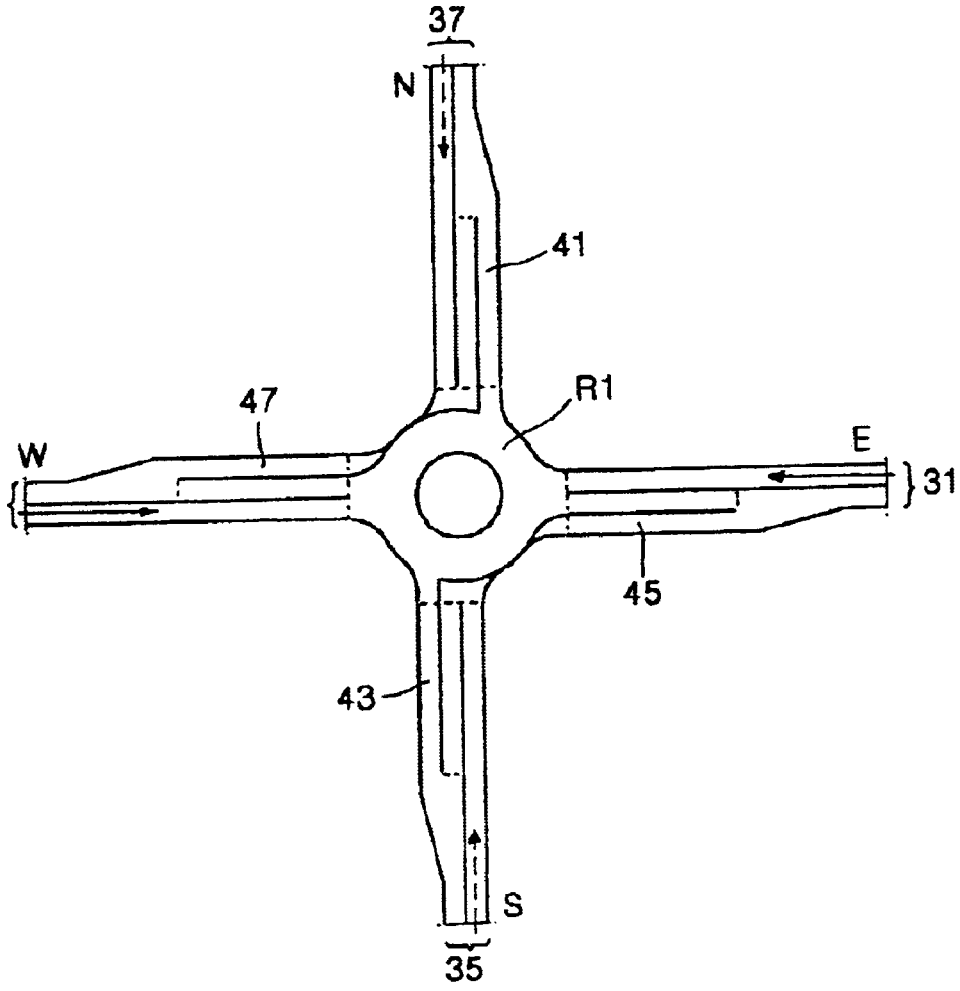
FIG. 22 is a plan view of FIG. 21.

FIGS. 21 and 22 illustrate a fourth example of System 2 of the present invention.

In this example, unlike FIG. 15, the one-way roads that constitute a half-main-road are divided in the upper and lower levels at the outside of the intersection. Accordingly, not merely entrance roads but an one-way road of each half-main-road has a sloping section, and this one-way road, taking the upper level at one end and the lower level at the other, is connected with the entrance roads running in the same direction. For instance, the one-way road of half-main-road 31, in the R1E direction, descends in a downward sloping section after departing from the ring-shaped road R1 to become a lower level road there and to join Entrance road 45 of the ring-shaped road R2.

Figure 23:
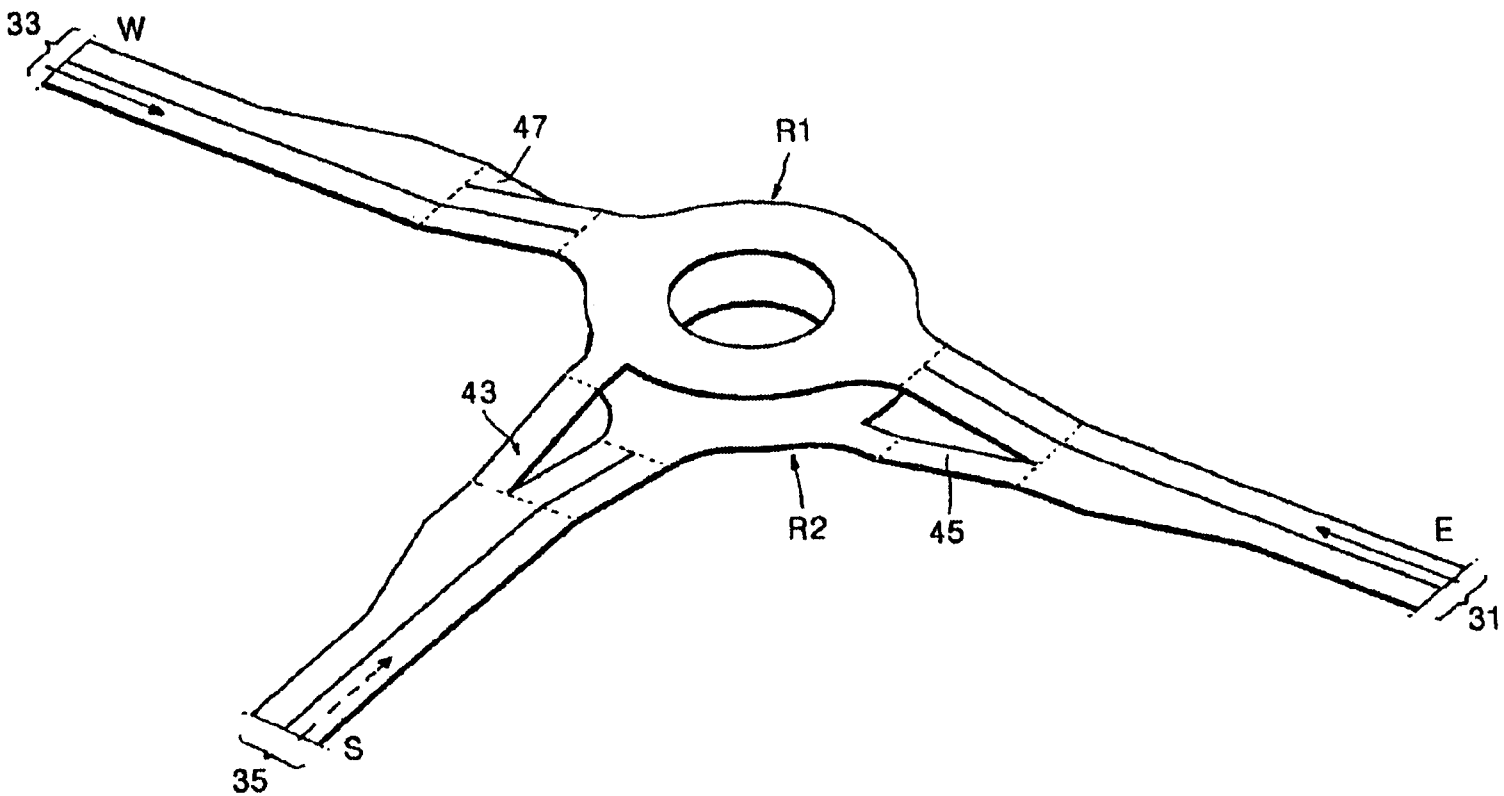
FIG. 23 is a schematic perspective view of a variation of System 2 of the present invention adapted for use for a 3-way intersection.
Figure 24:
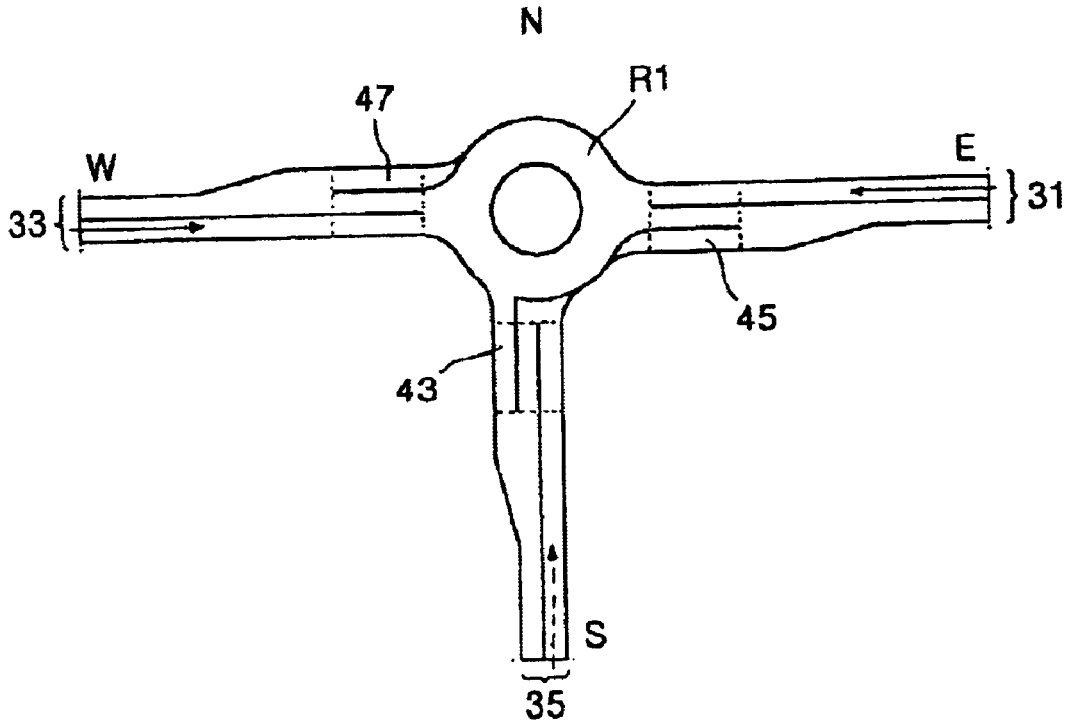
FIG. 24 is a plan view of FIG. 23.

Meanwhile, these examples are all for a 4-way intersection, but they can easily be adapted to 3-way intersections, too, as seen in FIGS. 23 and 24.

For instance, in FIG. 23, the half-main-road connected with the lower level ring-shaped road R2, is only one, half-main-road 35; the upper level ring-shaped road R1, has only one entrance road, Entrance road 43, that joins half-main-road 35. That is, the lower level ring-shaped road R2, does not have half-main-road 37, found in FIG. 19, and the upper level ring-shaped road R1, does not have Entrance road 41 in FIG. 19.

In a system for 3-way intersections of such a construct, the angle formed by half-main-roads 31, 33, and 35 can be adapted to suit to any given conditions of a 3-way intersection. Also, all sorts of variations can be made use of for all 3-way intersections, as is the case with the 4-way intersection above.

3. System 3

Figure 25:
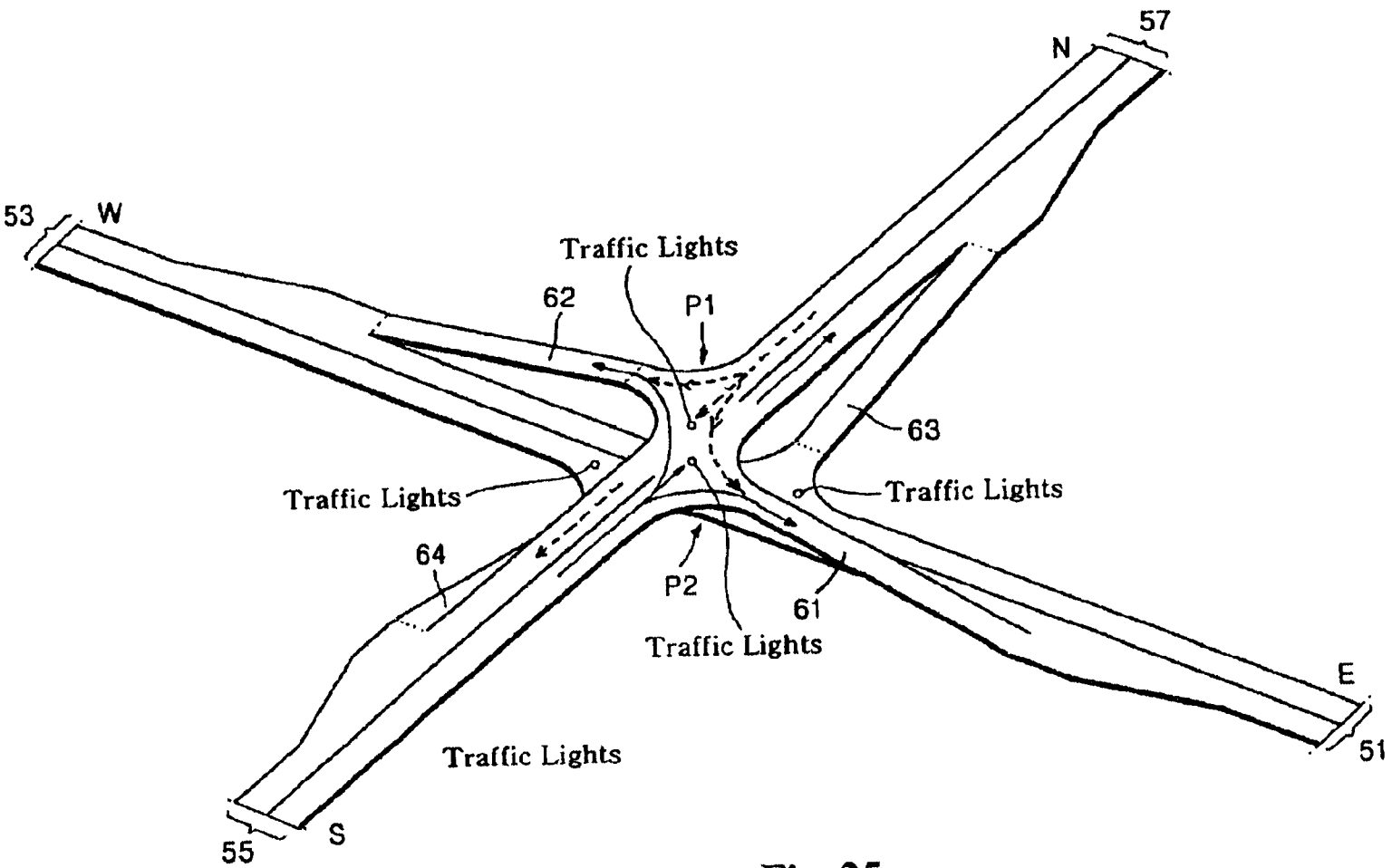
FIG. 25 is a schematic perspective view of an embodiment of System 3 of the present invention.
Figure 26:
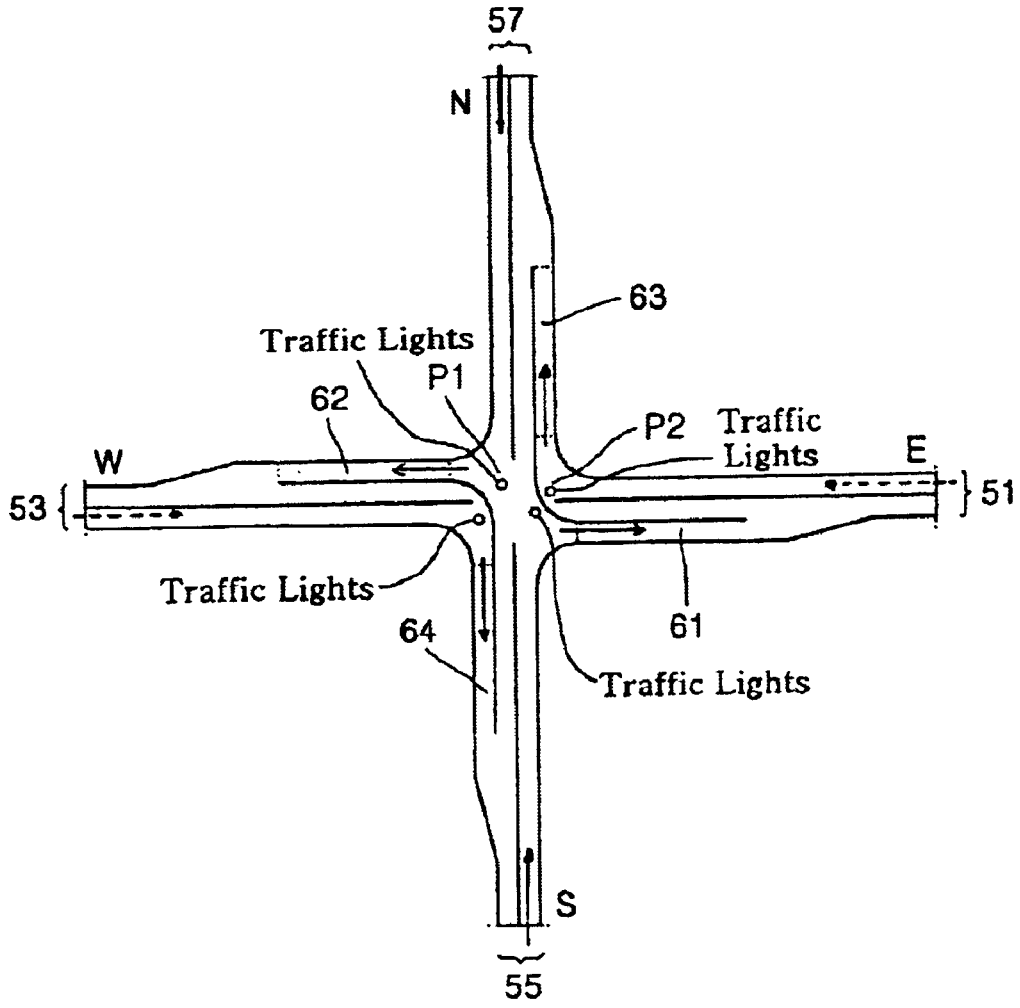
FIG. 26 is a plan view of FIG. 25.

Below, explanation of examples of System 3 of the present invention follows:

FIGS. 25 and 26 are the drawings for illustration of an example of System 3 of the present invention.

As is seen in the drawings, this particular system has plate-shaped roads P1 and P2, built in the center, on both lower and upper levels.

Along the edges on both sides of P1 extend two half-main-roads, 55 and 57, in two given directions (in the south and north in the drawings) and entries 61 and 62 in the other two directions.

Along the edges of plate-shaped road P2 on the lower level extend half-main-roads 51 and 53 in the two directions (east and west in the drawings) other than the directions where half-main-roads 55 and 57 of P1 on the upper level are connected; and Entrance roads 63 and 64 extend in the other two directions.

In other words, half-main-roads 55 and 57 connected with P1 on the upper level, half-main-roads 51 and 53 connected with P2 on the lower level, Entrance roads 61 and 62 connected with P1 on the upper level, and Entries 63 and 64 connected with P2 on the lower level respectively have different directions, when seen in a plan view.

Also, one or more of the two one-way roads which constitute the respective half-main-roads 51, 53, 55, and 57 or the above entrance roads have a sloping section. The above entrance roads are each connected with the one-way road, of the one-way roads of the half-main-roads on the upper or lower level, which extends in the same direction as that of them. For instance, in the case of P1W direction, Entrance road 62 which joins half-main-road 53 on the lower level, diverges from P1, and, after getting low by running through the sloping section, is connected with the one-way road in of half-main-road 53 in the P2W direction. Same is the case with all the other directions.

Meanwhile, on each of the upper and lower level plate-shaped roads or for each entering one-way road there are traffic lights set up to control the traffic flowing in from all directions.

For these traffic lights, ones for the straight way onward and the left turn together, or ones solely for the left turn are both practicable.

Now the actual passage of cars by this system will be explained.

Imagine that cars are entering in the SP1 direction. They approach the plate-shaped road P1, and if they want to make a turn to the right they just go on to Entrance road 61 in the P1E direction. To go on straight onward or make a turn to the left they have to stop and wait for the change of the light, unless they, having the light by chance at the instant, just go on. This applies to all cars entering the plate-shaped roads, the upper or the lower level notwithstanding.

Under such a system, the time the cars have to wait for the light is less long than in the case of a conventional single level intersection. Because the lights function separately for the upper and lower level plate-shaped roads, a great deal more versatile operation of these lights can be made available for better effects.

The sizes of these plate-shaped roads can be decided in consideration of the speed to be allowed to cars, the size of land available for such a system, the number of lanes the roads should have, and other similar requirements.

It is also possible to apply various adaptations and variations to System 3 of the present invention.

Figure 27:
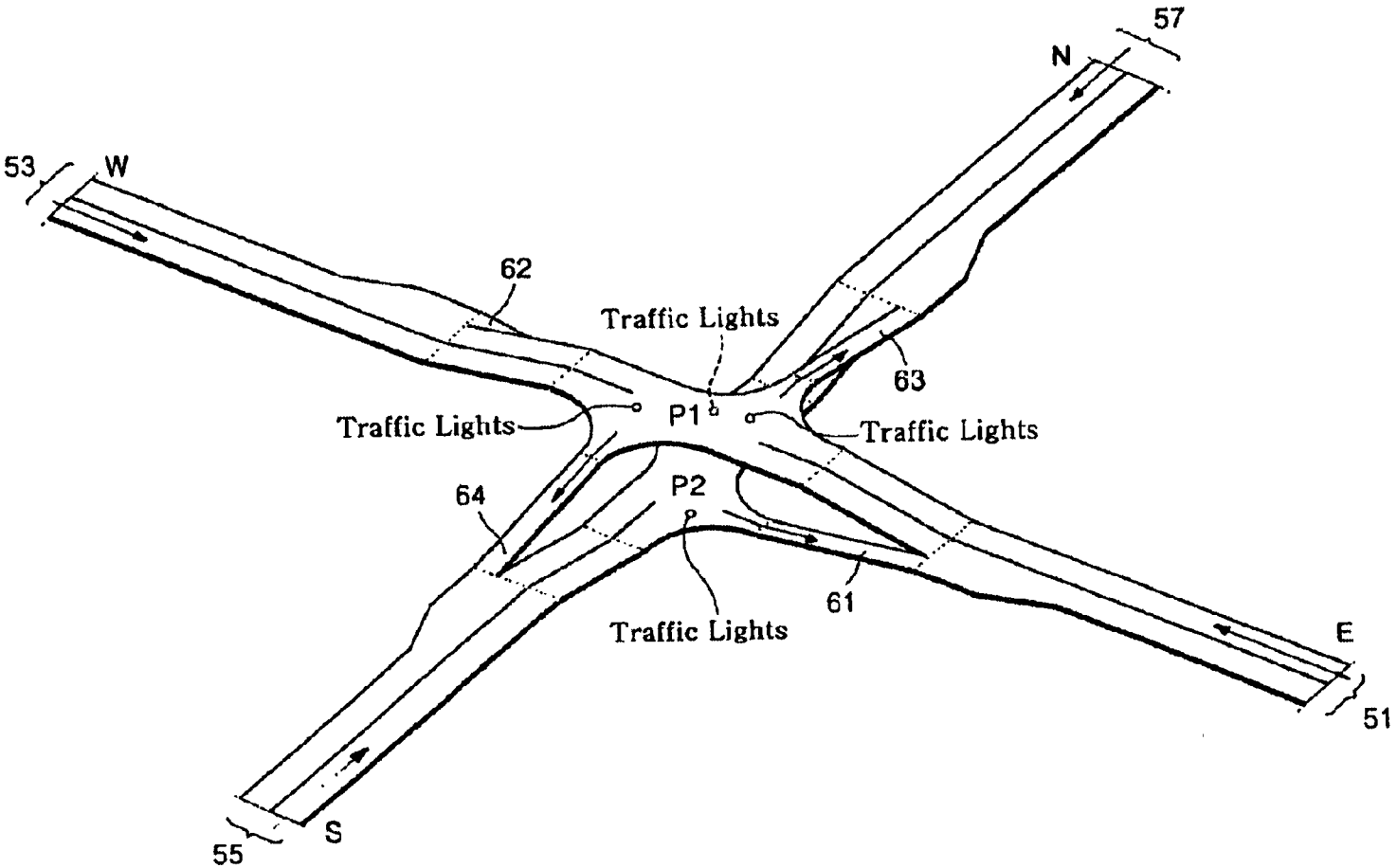
FIG. 27 is a schematic perspective view of a second embodiment of System 3 for the present invention.
Figure 28:
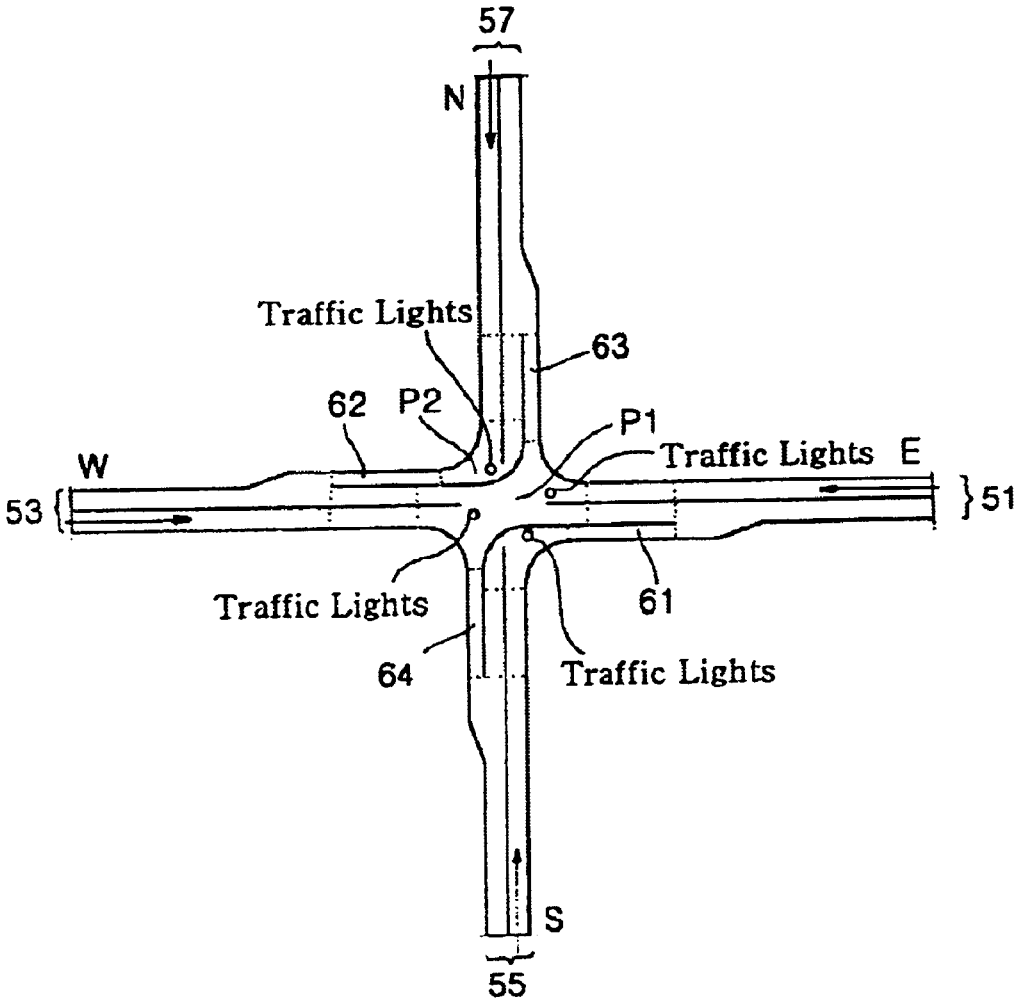
FIG. 28 is a plan view of FIG. 27.

FIGS. 27 and 28 illustrate a second example of System 3.

In the foregoing examples it is possible to divide the intersection into the upper and the lower level roads and the sloping sections. However, FIG. 27 is a case, where there is a medium-height section of the road between the upper and the lower levels, parallel with the surface of the ground. Therefore, there are to be seen three road levels parallel with the surface of the ground, when seen either from the front or at a side of the intersection.

For more details, in FIG. 27 the four half-main-roads, 51, 53, 55, and 57, have a medium height between upper and lower levels at the outside of the plate-shaped roads. As they approach the plate-shaped roads, plate-shaped roads 55 and 57 take a downward sloping section and afterwards are connected with the lower level plate-shaped road P2, while half-main-roads 51 and 53 are, after an upward sloping section, connected with the upper level plate-shaped road P1.

Accordingly Entrance roads 63 and 64 connected with half-main-roads 55 and 57 from the plate-shaped road P1, take a downward sloping section, while Entrance roads 61 and 62 connected with half-main-roads 51 and 53 from P2 take an upward sloping section.

In such an intersection system it is possible to shorten the length of the sloping sections, while still securing room of more than the height of cars between the upper and lower level roads.

Figure 29:
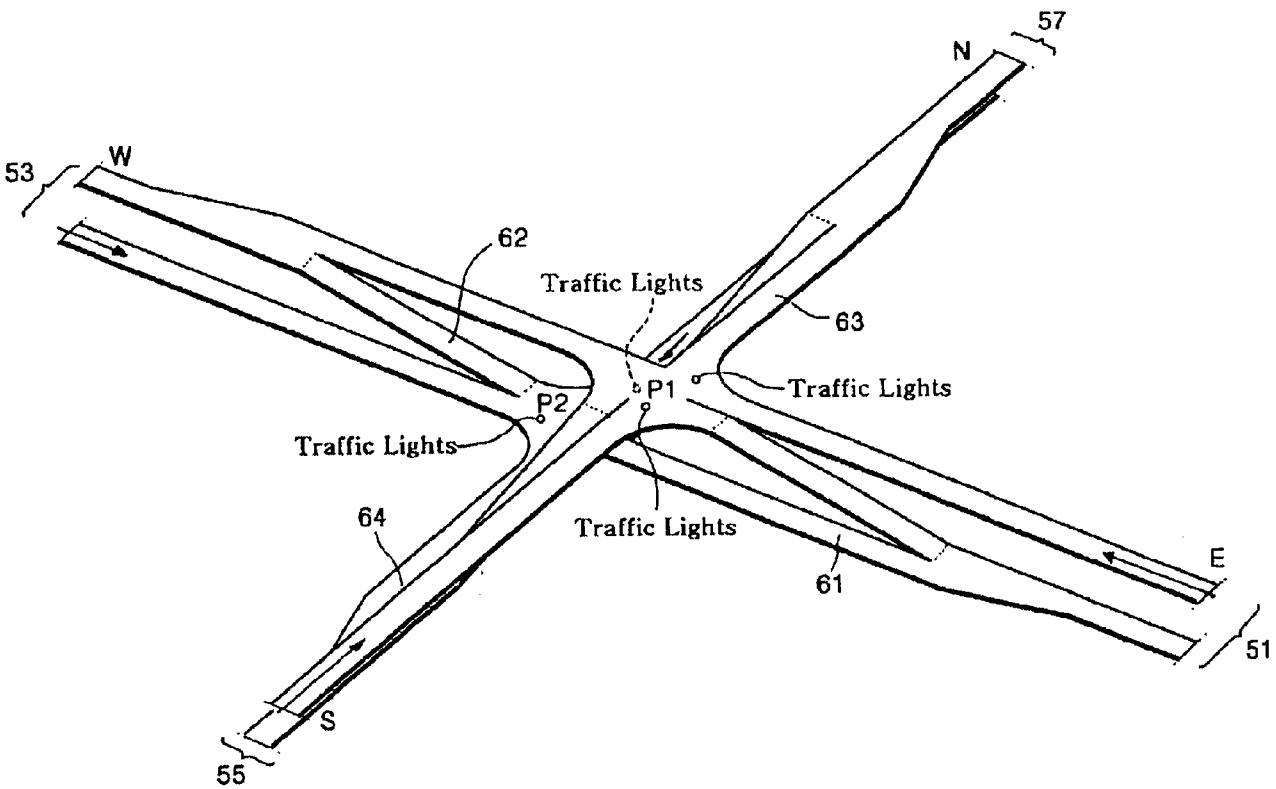
FIG. 29 is a schematic perspective view of a third embodiment of System 3 of the present invention.
Figure 30:
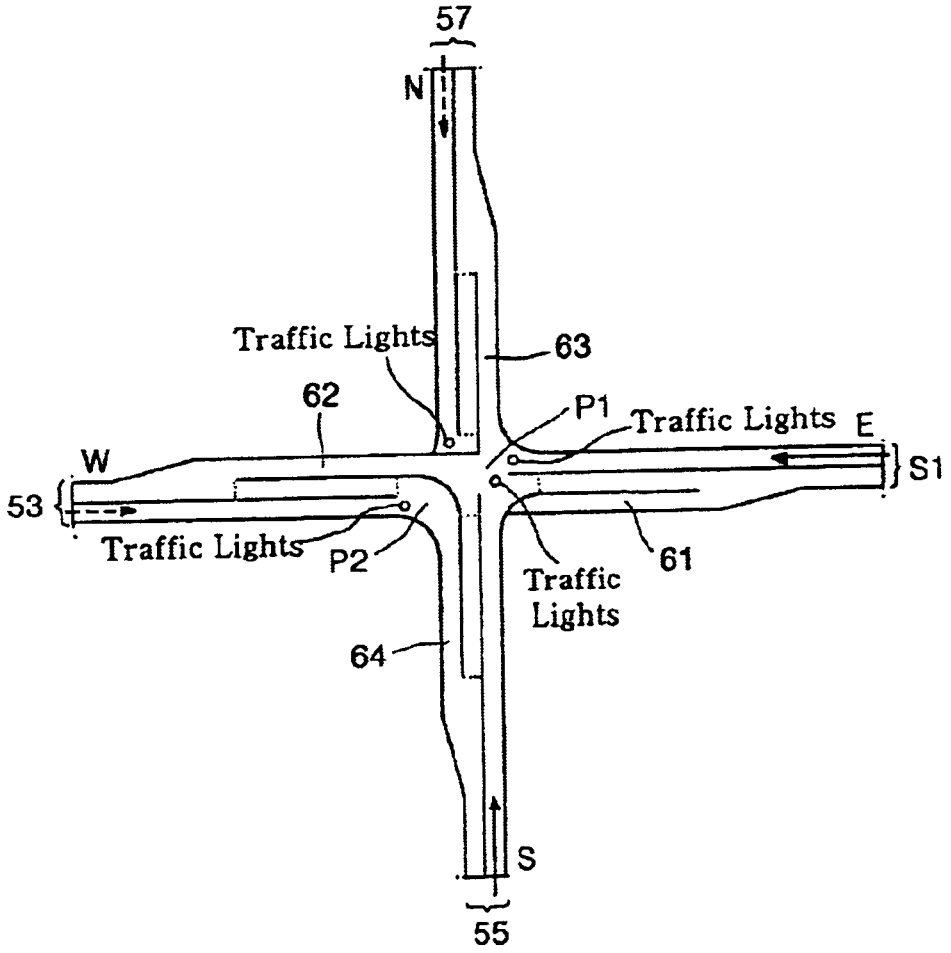
FIG. 30 is a plan view of FIG. 29.

Moreover, such a system of intersection of the present invention can be variously adapted to suit different actual conditions of roads. Take the example illustrated in FIGS. 29 and 30 as an example, and it will be seen that the two one-way roads constituting each half-main-road are each built in an upper and a lower level construction. There, the one-way road of half-main-road 51 in the P1E direction diverges to plate-shaped road P1, takes the downward sloping section, reaches down, and becomes a lower level road, departing from the intersection system in fine.

In this example, the angles formed by the half-main-roads 51, 55, and by 53 and 57 respectively connected with the plate-shaped roads P1 and P2 are each 90°, unlike in the foregoing examples.

Figure 31:
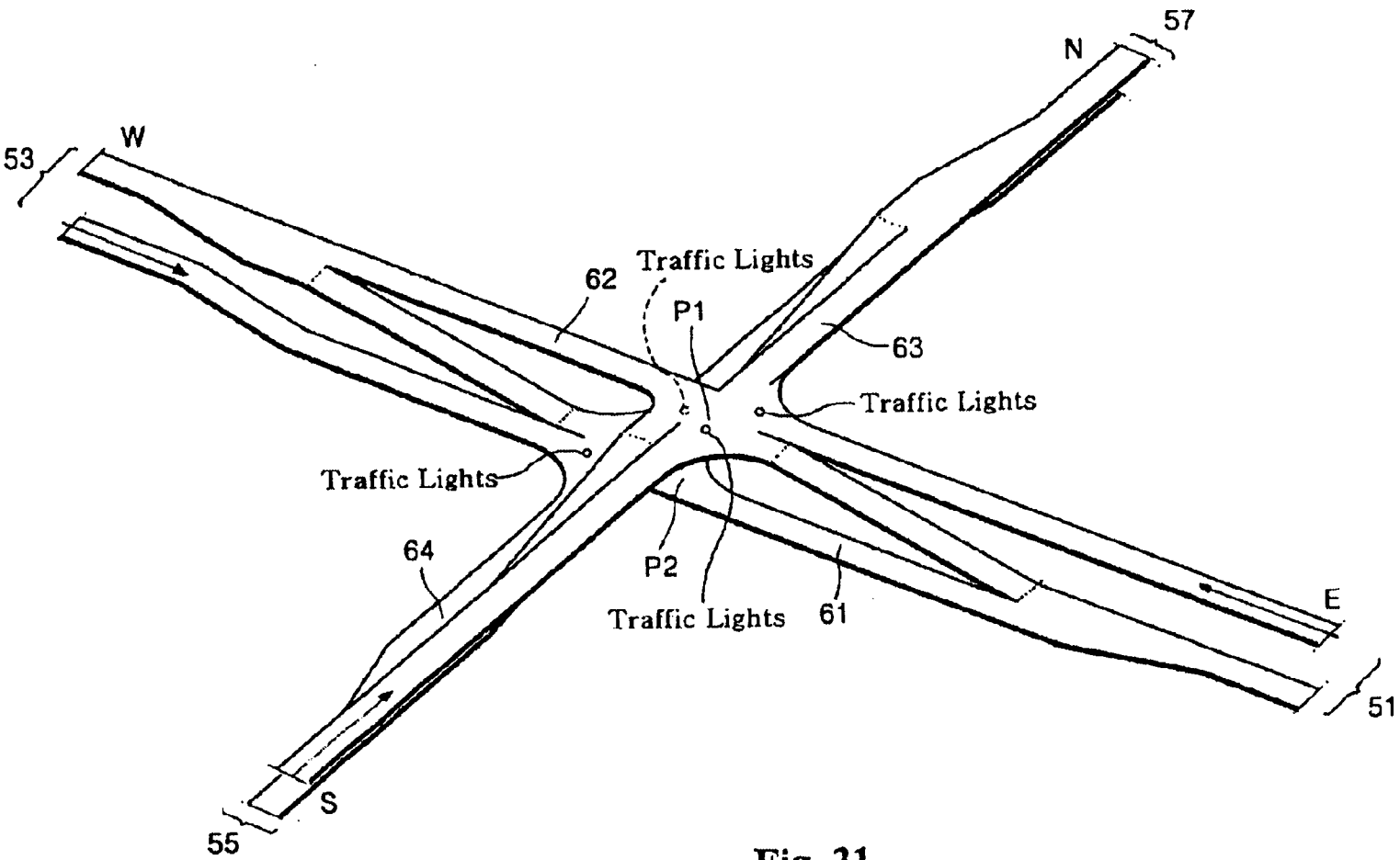
FIG. 31 is a schematic perspective view of a fourth embodiment of System 3 of the present invention.
Figure 32:
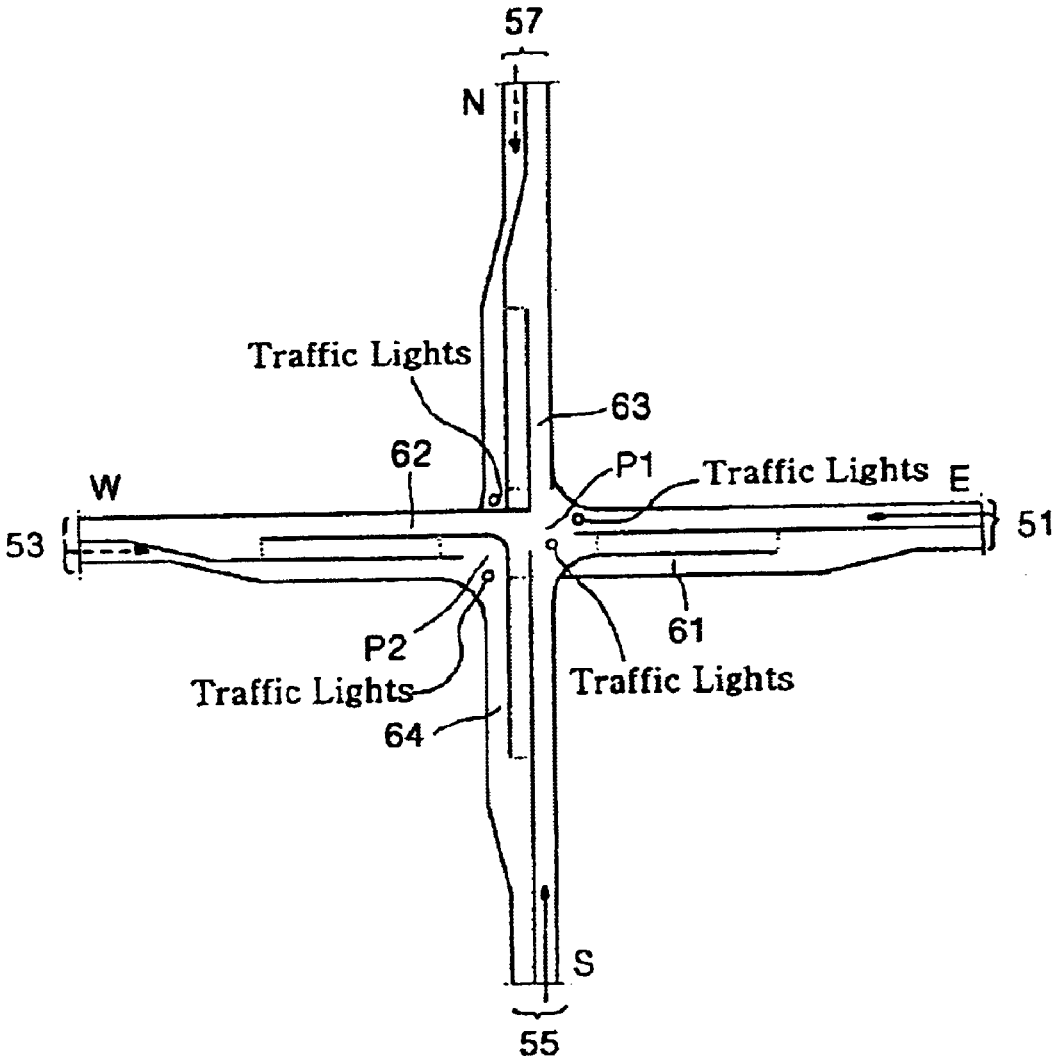
FIG. 32 is a plan view of FIG. 31.

In all the preceding examples the entrance roads from a plate-shaped road are made to curve toward the one-way road when they are connected with an one-way road of a half-main-road, but in the examples given in FIGS. 31 and 32 the entrance roads are in a straight line, showing that it is all right even if one or more of the one-way roads of a half-main-road may curve in the direction of the breadth of the road and is connected with an entrance road. In other words, in FIG. 31, Entrance roads 61 and 64 curve toward the half-main-roads when they join half-main-roads 51 and 55 respectively, while in the cases of Entrance roads 62 and 63 half-main-roads 53 and 57 respectively curve toward Entrance roads 62 and 63 to join them respectively.

While this invention has been particularly shown and described with references to preferred embodiments thereof, it will be understood by those skilled in the art that various changes in form and details may be made therein without departing from the scope of the invention encompassed by the appended claims.

The present invention is not confined to these examples explicated above alone, but can be applied to various other situations by a suitable adaptation or modification within the range of its basic technical idea.

A variety of examples of embodiments of the three intersection systems of the present invention have been explained above. In a place where there are a large number of intersections, more than one of the above systems can be built in combination, whereby passage of vehicles can be better facilitated in an efficient traffic control with no light at all, or only two or fewer at most.

Admittedly there are countries in the world where a keep-to-the-left principle is adopted for the traffic, but the systems of the present invention can serve with all the same efficiency only by switching the directions. Therefore, such countries do not fall out of the range of the present invention.

The intersection systems of the present invention can bring forth benefits in the industry and national economy in general by means of ridding intersections of traffic lights, or minimizing the time drivers waste waiting for the change of lights, thus helping with the smooth flow of cars, easing traffic congestion, decreasing the land to be occupied by conventional intersection systems, and contributing to the more effective exploitation of land.

What is claimed is:

1. An intersection system, comprising:

a plate-shaped road, on each of upper and lower levels, respectively, at a central section of an intersection, each having left and right turns for opposing traffic onto entrance roads;

half-main-roads in two respective directions, and in two other directions being connected to edges of the plate-shaped roads of said upper level and lower level, respectively;

said half-main-roads on the upper level and those of the lower level, being in different directions with respect to each other in a plane, and said entrance road of the upper level and those of the lower level, being in different directions as well;

one or more one-way roads constituting half-main-roads or entrance roads having a sloping section;

said entrance roads being connected to either of the one-way roads of the upper or lower level, traffic moving in a same direction of said entrance roads;

traffic lights at said plate-shaped roads of the upper and lower levels, and at the respective one-way road entrance roads, for the benefit of the traffic entering from respective directions therein.

2. An intersection system of claim 1, wherein the one-way roads constituting one half-main-road are divided alternatively in an upper level and lower level road at the outside of the intersection, and one of said one-way roads has a sloping section with one end forming an upper level and the other end a lower level road, connected with the entrance road running in a same direction.

3. An intersection system of claim 1 or claim 2, wherein part of said lower level road is built lower than ground level.

4. An intersection system, comprising:

two main roads, main road 1 and main road 2 having an intersection;

respective one-way roads constituting said main roads, a diverging section for right and left turns being installed at entrance portions of the intersection, and a converging section being installed at exit portions of the intersection of said one-way roads, said converging section having a primary merging of vehicles which are turned to the right and left from other one-way roads, wherein said converging section has only one-side convergence, said intersection being provided with such characteristics that:

in two one-way roads constituting one main road, if the entrance portion of the intersection is an upper level, the exit portion of the intersection is a lower level, if the entrance portion of the intersection is a lower level, the exit portion of the intersection is an upper level, the entrance portion of the intersection in the main road 1 and the exit portion of the intersection in the main road 2 have a same level, the exit portion of the intersection in the main road 1 and the entrance portion of the intersection in the main road 2 have a same level, if the entrance portion of the intersection in the main road 1 and the exit portion of the intersection in the main road 2 are an upper level, the exit portion of the intersection in the main road 1 and the entrance portion of the intersection in the main road 2 are a lower level, if the entrance portion of the intersection in the main road 1 and the exit portion of the intersection in the main road 2 are a lower level, the exit portion of the intersection in the main road 1 and the entrance portion of the intersection in the main road 2 are an upper level, a central section of a main road has a same level as the entrance portion of the intersection in the same main road, said entrance portion of the intersection in the main road whose central section is an upper level, being an upper level, and said entrance portion of the intersection in the main road whose central section is a lower level, being a lower level, a right-turn private exit road of a one-way road contained in a main road diverges, and a left-turn private exit road of another one-way road contained in the same main road diverges, respectively, and after that, the exit roads merge into one road before a convergence to a one-way road of the other main road, the merged exit road is connected to one side of the converging section of the one-way road which has a same progression direction in another main road, in said diverging section and the converging section, if the diverging section of the main road 1 and the converging section of the main road 2 are an upper level, the diverging section of the main road 2 and the converging section of the main road 1 are a lower level, and if the diverging section of the main road 1 and the converging section of the main road 2 are a lower level, the diverging section of the main road 2 and the converging section of the main road 1 are an upper level.

5. An intersection system, comprising:

two main roads, main road 1 and main road 2 having an intersection;

respective one-way roads constituting said main roads, a diverging section for right and left turns being installed at one side of entrance portions of the intersection, and a converging section being installed at exit portions of the intersection of said one-way roads, said converging section having a merging of vehicles which are turned to the right and left from other one-way roads, an exit road which diverges from one side of said diverging section from one one-way road, said exit road being for both right and left turns and again diverging into a left turn exit road and a right turn exit road, and the exit roads being individually converged into the converging section of the one-way road which has the same progression direction of a main road which is perpendicularly intersected with the one-way road containing said exit roads, said intersection being provided by such characteristics that:

in two one-way roads constituting one main road, if an entrance portion of the intersection is an upper level, an exit portion of the intersection is a lower level, if the entrance portion of the intersection is a lower level, the exit portion of the intersection is an upper level, the entrance portion of the intersection in the main road 1 and the exit portion of the intersection in the main road 2 have a same level, the exit portion of the intersection in the main road 1 and the entrance portion of the intersection in the main road 2 have a same level, if the entrance portion of the intersection in the main road 1 and the exit portion of the intersection in the main road 2 are an upper level, the exit portion of the intersection in the main road 1 and the entrance portion of the intersection in the main road 2 are a lower level, if the entrance portion of the intersection in the main road 1 and the exit portion of the intersection in the main road 2 are a lower level, the exit portion of the intersection in the main road 1 and the entrance portion of the intersection in the main road 2 are an upper level, a central section of the main road has a same level as the exit portion of the intersection in the same main road, said exit portion of the intersection in the main road whose central section is an upper level, being an upper level, and said exit portion of the intersection in the main road whose central section is a lower level, being a lower level, in said diverging section and the converging section, if the diverging section of the main road 1 and the converging section of the main road 2 are an upper level, the diverging section of the main road 2 and the converging section of the main road 1 are a lower level, and if the diverging section of the main road 1 and the converging section of the main road 2 are a lower level, the diverging section of the main road 2 and the converging section of the main road 1 are an upper level.

* * * * *